US009139275B2

(12) United States Patent
Kimura et al.

(10) Patent No.: US 9,139,275 B2
(45) Date of Patent: Sep. 22, 2015

(54) SUSPENSION DEVICE FOR OUTBOARD MOTOR AND VESSEL PROPULSION APPARATUS

(71) Applicant: YAMAHA HATSUDOKI KABUSHIKI KAISHA, Iwata-shi, Shizuoka (JP)

(72) Inventors: Takashi Kimura, Shizuoka (JP); Yoshiyuki Kadobayashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 263 days.

(21) Appl. No.: 13/732,555

(22) Filed: Jan. 2, 2013

(65) Prior Publication Data

US 2013/0252491 A1 Sep. 26, 2013

(30) Foreign Application Priority Data

Mar. 22, 2012 (JP) ..... 2012-065801
Mar. 22, 2012 (JP) ..... 2012-065802
Mar. 22, 2012 (JP) ..... 2012-065803

(51) Int. Cl.
*B63H 20/12* (2006.01)
*B63H 20/10* (2006.01)
*B63H 20/00* (2006.01)

(52) U.S. Cl.
CPC ..... *B63H 20/12* (2013.01); *B63H 20/10* (2013.01); *B63H 21/26* (2013.01)

(58) Field of Classification Search
CPC ..... B63H 20/08; B63H 21/265; B63H 20/10; B63H 20/12
USPC ..... 440/61 R, 61 S, 53, 58, 59; 114/144 R, 114/144 RE
See application file for complete search history.

(56) References Cited

U.S. PATENT DOCUMENTS 4,419,083 A * 12/1983 Taguchi ..... 440/56
4,449,945 A * 5/1984 Ferguson ..... 440/53
4,689,024 A * 8/1987 Ferguson ..... 440/52

(Continued)

FOREIGN PATENT DOCUMENTS

JP 2009-083596 A 4/2009
JP 2010-162992 A 7/2010

(Continued)

OTHER PUBLICATIONS

Kadobayashi et al., "Suspension Device for Outboard Motor and Vessel Propulsion Apparatus", U.S. Appl. 13/732,559, filed Jan. 2, 2013.

(Continued)

*Primary Examiner* — Edwin Swinehart
(74) *Attorney, Agent, or Firm* — Keating & Bennett, LLP

(57) ABSTRACT

A suspension device includes a clamp bracket, a tilting shaft, a swivel bracket, and a steering shaft. An outboard motor is to be connected to the steering shaft. The steering shaft is to be driven about a central axis of the steering shaft by either one of an electric steering mechanism and a hydraulic steering mechanism. The swivel bracket includes a placing portion arranged to support the electric steering mechanism and a wall portion arranged to support the hydraulic steering mechanism at a position different from that of the electric steering mechanism, and supports either one of the electric steering mechanism and hydraulic steering mechanism.

18 Claims, 23 Drawing Sheets

(56) References Cited

U.S. PATENT DOCUMENTS

| | | | | |
|---|---|---|---|---|
| 2009/0084299 | A1 | 4/2009 | Mizutani | |
| 2010/0120303 | A1 * | 5/2010 | Murai et al. | 440/59 |

FOREIGN PATENT DOCUMENTS

| | | | |
|---|---|---|---|
| JP | 2010-162999 | A | 7/2010 |
| JP | 2010-173446 | A | 8/2010 |

OTHER PUBLICATIONS

Takase et al., "Marine Vessel Propulsion Apparatus", U.S. Appl. No. 13/212,247, filed Aug. 18, 2011.

Takase et al.; "Marine Vessel Propulsion Apparatus"; U.S. Appl. No. 13/212,256, filed Aug. 18, 2011.

Takase; "Marine Vessel Propulsion Apparatus"; U.S. Appl. No. 13/212,258, filed Aug. 18, 2011.

* cited by examiner

SUSPENSION DEVICE FOR OUTBOARD MOTOR AND VESSEL PROPULSION APPARATUS

BACKGROUND OF THE INVENTION

1. Field of the Invention

The present invention relates to a suspension device which attaches an outboard motor to a hull, and also relates to a vessel propulsion apparatus which propels a vessel.

2. Description of the Related Art

Suspension devices including electric steering mechanisms and suspension devices including hydraulic steering mechanisms have been known. For example, Japanese Unexamined Patent Application Publication No. 2010-173446, Japanese Unexamined Patent Application Publication No. 2010-162999, Japanese Unexamined Patent Application Publication No. 2010-162992, and Japanese Unexamined Patent Application Publication No. 2009-83596 disclose suspension devices including electric steering mechanisms. These electric steering mechanisms are attached to swivel brackets that support outboard motors. The electric steering mechanisms are partially integrated with the swivel brackets.

In the case of using a hydraulic steering mechanism, no electric steering mechanism is necessary. Similarly, in the case of using an electric steering mechanism, no hydraulic steering mechanism is necessary. However, in Japanese Unexamined Patent Application Publication No. 2010-173446, Japanese Unexamined Patent Application Publication No. 2010-162999, Japanese Unexamined Patent Application Publication No. 2010-162992, and Japanese Unexamined Patent Application Publication No. 2009-83596, because the electric steering mechanism is partially integrated with the swivel bracket, it is not possible to remove the electric steering mechanism and attach a hydraulic steering mechanism to the same swivel bracket. Therefore, there is a need for a swivel bracket for the electric steering mechanism and a swivel bracket for the hydraulic steering, and common use of components cannot be realized.

SUMMARY OF THE INVENTION

In order to overcome the previously unrecognized and unsolved challenges described above, a first preferred embodiment of the present invention provides a suspension device for an outboard motor, including a clamp bracket, a tilting shaft, a swivel bracket, and a steering shaft. The clamp bracket is to be attached to a hull. The tilting shaft is connected to the clamp bracket. The swivel bracket includes a first support portion arranged to support a first steering mechanism and a second support portion arranged to support a second steering mechanism at a position different from that of the first steering mechanism. The swivel bracket is connected to the tilting shaft. The swivel bracket is rotatable about a central axis of the tilting shaft relative to the clamp bracket. The swivel bracket supports either one of the first steering mechanism and second steering mechanism. The steering shaft is held by the swivel bracket rotatably about a central axis of the steering shaft. The steering shaft is to be driven about the central axis of the steering shaft by either one of the first steering mechanism and the second steering mechanism. The steering shaft is to be connected to an outboard motor.

According to this arrangement, the steering shaft to be connected to an outboard motor is held by the swivel bracket rotatably about a central axis (hereinafter, referred to as a "steering axis") of the steering shaft. The swivel bracket is connected to the tilting shaft, and the tilting shaft is connected to the clamp bracket to be attached to a hull. The swivel bracket includes a first support portion arranged to support a first steering mechanism and a second support portion arranged to support a second steering mechanism at a position different from that of the first steering mechanism. The first steering mechanism and the second steering mechanism cause the steering shaft to turn about the steering axis. The swivel bracket is capable of supporting either of the first steering mechanism and the second steering mechanism. Therefore, in case of using either the first steering mechanism or the second steering mechanism, a common swivel bracket can be used. Thus, it is not necessary to prepare a plurality of different specifications of swivel brackets. Accordingly, common use of components, such as swivel brackets, can be realized. Moreover, a user can select either steering mechanism, and can also replace one steering mechanism with the other steering mechanism after setting one of the steering mechanisms.

In the first preferred embodiment of the present invention, the swivel bracket preferably include a placing portion serving as the first support portion on which the first steering mechanism is located and a pair of wall portions serving as the second support portion disposed on both left and right sides of the placing portion. The placing portion and the pair of wall portions preferably define a recessed disposition space that is opened forward and upward and in which the first steering mechanism is disposed.

Moreover, in the first preferred embodiment of the present invention, the tilting shaft preferably includes two divided shafts disposed on the same axis. In this case, the divided shafts preferably include shaft portions inserted in insertion holes provided in the pair of wall portions and flange portions disposed between the pair of wall portions and having an outer diameter larger than the diameter of the insertion holes.

Moreover, in the first preferred embodiment of the present invention, the suspension device preferably further includes a first steering arm connected to the steering shaft, and arranged to rotate about a central axis of the steering shaft together with the steering shaft. In this case, the swivel bracket preferably further includes a recessed arm housing portion in which the first steering arm is housed.

Moreover, in the first preferred embodiment of the present invention, the suspension device preferably further includes an arm cover attached to the swivel bracket and covering the arm housing portion. In this case, the suspension device preferably further includes a seal disposed between the arm cover and the swivel bracket. The seal may preferably be a gasket or an O-ring, for example.

Moreover, in the first preferred embodiment of the present invention, the suspension device preferably further includes an arm attaching portion to which a second steering arm is to be removably attached. The arm attaching portion is preferably arranged to rotate about the central axis of the steering shaft together with the steering shaft. Further, the arm attaching portion is preferably arranged to support the second steering arm attached to the arm attaching portion at a height higher than that of the first steering arm.

Moreover, in the first preferred embodiment of the present invention, the suspension device preferably further includes an electric steering mechanism defining the first steering mechanism, supported by the first support portion, and arranged to cause the steering shaft to rotate about a central axis of the steering shaft. In this case, the suspension device preferably further includes a first steering arm that rotates about the central axis of the steering shaft together with the steering shaft. The first steering arm preferably includes one end portion (first end portion) connected to the steering shaft and the other end portion (second end portion) connected to the first steering mechanism. In this case, one end portion of the first steering arm is preferably fixed to the steering shaft by at least one of the press fitting, bolting, and welding, for example. Specifically, one end portion of the first steering arm is preferably fixed to the steering shaft by spline press-fitting, for example.

Moreover, in the first preferred embodiment of the present invention, the suspension device preferably further includes the second steering mechanism supported by the second support portion, and arranged to cause the steering shaft to rotate about the central axis of the steering shaft. In this case, the suspension device preferably further includes a second steering arm that rotates about a central axis of the steering shaft together with the steering shaft. The second steering arm preferably includes one end portion (first end portion) connected to the steering shaft and the other end portion (second end portion) connected to the second steering mechanism.

Moreover, in the first preferred embodiment of the present invention, the tilting shaft is preferably supported by the second support portion. In this case, the second steering mechanism is preferably supported by the second support portion via the tilting shaft. Alternatively, the second steering mechanism may preferably be directly supported by the second support portion.

Moreover, in the first preferred embodiment of the present invention, the suspension device preferably further includes an arm attaching portion to which one end portion of the second steering arm is removably attached. The arm attaching portion is preferably arranged to rotate about a central axis of the steering shaft together with the steering shaft. One end portion of the second steering arm is preferably removably attached to the arm attaching portion by a bolt, for example.

Moreover, in the first preferred embodiment of the present invention, the second steering mechanism preferably is a hydraulic steering mechanism. A steering mechanism other than a hydraulic steering mechanism may preferably define a second steering mechanism.

A second preferred embodiment of the present invention provides a suspension device for an outboard motor, including a clamp bracket, a tilting shaft, a swivel bracket, and a steering shaft. The clamp bracket is to be attached to a hull. The tilting shaft is connected to the clamp bracket. The swivel bracket is connected to the tilting shaft, and is rotatable about a central axis of the tilting shaft relative to the clamp bracket. The steering shaft is held by the swivel bracket rotatably about a central axis of the steering shaft. The steering shaft includes a first connecting portion connectable to a first steering mechanism and a second connecting portion connectable to a second steering mechanism at a position different from that of the first steering mechanism. The steering shaft is to be driven about the central axis of the steering shaft by either one of the first steering mechanism connected to the first connecting portion and the second steering mechanism connected to the second connecting portion. The steering shaft is to be connected to an outboard motor. The same advantageous effects as those of the suspension device according to the first preferred embodiment of the present invention are achieved by the second preferred embodiment of the present invention.

In the second preferred embodiment of the present invention, the first steering mechanism preferably is an electric steering mechanism. The first connecting portion preferably is a first steering arm connected to the steering shaft, and arranged to rotate about the central axis of the steering shaft together with the steering shaft.

Moreover, in the second preferred embodiment of the present invention, the second steering mechanism preferably is a hydraulic steering mechanism. The second connecting portion preferably is connectable to the second steering mechanism via a second steering arm arranged to rotate about the central axis of the steering shaft together with the steering shaft. The second steering arm preferably includes one end portion (first end portion) to be connected to the second connecting portion, and the other end portion (second end portion) to be connected to the hydraulic steering mechanism.

A third preferred embodiment of the present invention provides a suspension device for an outboard motor, including a clamp bracket, a tilting shaft, a swivel bracket, a steering shaft, a holding member, an electric motor, and a transmitter. The clamp bracket is to be attached to a hull. The tilting shaft is connected to the clamp bracket. The swivel bracket is connected to the tilting shaft, and rotatable about a central axis of the tilting shaft relative to the clamp bracket. The steering shaft is held by the swivel bracket rotatably about a central axis of the steering shaft. The steering shaft is to be connected to an outboard motor. The electric motor produces power to rotate the steering shaft about a central axis of the steering shaft. The transmitter transmits power from the electric motor to the steering shaft side. The electric motor and transmitter are held by the holding member. The holding member is located on a placing portion provided in the swivel bracket. The holding member is removably attached to the swivel bracket.

According to this arrangement, the steering shaft to be connected to an outboard motor is held by the swivel bracket rotatably about a central axis (hereinafter, referred to as a "steering axis") of the steering shaft. The swivel bracket is connected to the tilting shaft, and the tilting shaft is connected to the clamp bracket to be attached to a hull. The suspension device includes an electric steering mechanism that causes the steering shaft to turn about the steering axis. Specifically, the suspension device includes a holding member located on a placing portion provided in the swivel bracket, an electric motor which produces power, and a transmitter which transmits power from the electric motor to the steering shaft side.

The holding member is removably attached to the swivel bracket. The electric motor and the transmitter are held by the holding member. Therefore, by removing the holding member from the swivel bracket, the holding member, the electric motor, and the transmitter can be removed all at once from the swivel bracket. Thus, the electric steering mechanism can be maintained in a state removed from the swivel bracket. Consequently, maintenance can be performed more efficiently than when the electric steering mechanism is integrated with the swivel bracket. Further, the weight of the suspension device can be greatly reduced when the electric steering mechanism is unnecessary. Furthermore, it is not necessary to replace the swivel bracket when the electric steering mechanism is damaged.

In the third preferred embodiment of the present invention, the suspension device preferably further includes a steering arm connected to the steering shaft, and arranged to rotate together with the steering shaft about a central axis of the steering shaft. In this case, the suspension device preferably is arranged to be able to turn the outboard motor by transmitting power to the steering arm from the transmitter.

Moreover, in the third preferred embodiment of the present invention, the holding member preferably includes a case that holds the electric motor in the interior of the case and is provided with a first opening. In this case, the transmitter preferably transmits power from the electric motor to the steering shaft side through the first opening.

Moreover, in the third preferred embodiment of the present invention, the suspension device preferably further includes a steering arm connected to the steering shaft and rotating together with the steering shaft about a central axis of the steering shaft. The holding member preferably includes a case that holds the electric motor in the interior of the case. The swivel bracket preferably includes an arm housing portion, in which the steering arm is housed, communicating with a first opening provided in the case. The transmitter preferably transmits power on a transmission channel that extends to the exterior of the case from the interior of the case through the first opening, and connects the electric motor and the steering arm.

Moreover, in the third preferred embodiment of the present invention, the suspension device preferably further includes a first seal disposed between the case and the swivel bracket, and surrounding the first opening of the case. The first seal may preferably be a gasket or an O-ring, for example.

In the third preferred embodiment of the present invention, the suspension device preferably further includes a fastening member fastening the case and the swivel bracket with the first seal sandwiched between the case and the swivel bracket. The fastening member may preferably be a bolt, a hook, or a band, for example.

Moreover, in the third preferred embodiment of the present invention, the suspension device preferably further includes an arm cover covering the arm housing portion and provided with a second opening arranged to cause the first opening of the case and the arm housing portion to communicate with each other. In this case, the suspension device preferably further includes a second seal disposed between the arm cover and the swivel bracket. The second seal may preferably be a gasket or an O-ring, for example.

Moreover, in the third preferred embodiment of the present invention, the suspension device preferably further includes a connecting member removably connecting the holding member and the swivel bracket.

Moreover, in the third preferred embodiment of the present invention, the swivel bracket preferably includes a pair of wall portions disposed on both left and right sides of the placing portion, and connected to a side portion of the holding member. In this case, the connecting member preferably includes a bolt that removably connects a side portion of the holding member and the pair of wall portions. Moreover, the suspension device preferably further includes a boss portion projecting from at least one of the holding member and the swivel bracket, and interposed between a side portion of the holding member and the pair of wall portions.

Moreover, in the third preferred embodiment of the present invention, the suspension device preferably further includes a turning angle detector held by the holding member and arranged to detect a rotation angle of the steering shaft. According to this arrangement, because the electric motor is controlled based on a detection value of the turning angle detector, a rotation angle of the steering shaft, that is, a turning angle of the outboard motor can be controlled with high accuracy. Further, because the turning angle detector is held by the holding member, the holding member, the electric motor, the transmitter, and the turning angle detector can be removed all at once from the swivel bracket by removing the holding member from the swivel bracket.

Moreover, in the third preferred embodiment of the present invention, the transmitter preferably includes a ball screw to be rotationally driven by the electric motor and a ball nut attached to the ball screw. In this case, the turning angle detector preferably includes a rotation angle detector that detects a rotation angle of the steering shaft by detecting a rotation angle of the ball screw.

Moreover, in the third preferred embodiment of the present invention, the steering arm preferably includes an annular arm portion in which the steering shaft is inserted and that rotates together with the steering shaft, and an arm portion that extends outward from the annular arm portion.

Moreover, in the third preferred embodiment of the present invention, the suspension device preferably further includes a tubular bushing disposed between the steering arm and the transmitter. The bushing preferably includes an outer peripheral surface having a polygonal sectional shape and a cylindrical inner peripheral surface. In this case, the transmitter preferably includes a transmission shaft inserted inside the bushing rotatably relative to the bushing. The steering arm preferably includes a forked arm portion disposed around the bushing and prevented from rotating relative to the bushing.

Moreover, in the third preferred embodiment of the present invention, the tilting shaft preferably includes two divided shafts disposed on the same axis.

Moreover, in the third preferred embodiment of the present invention, the transmitter preferably includes a clutch arranged to transmit torque in a normal rotation direction and a reverse rotation direction from the electric motor side to the steering shaft side, and shutting off torque transmission from the steering shaft side to the electric motor side. In this case, the transmitter preferably further includes a damper disposed closer to the steering shaft than the clutch and arranged to absorb vibration in a normal rotation direction and a reverse rotation direction.

A fourth preferred embodiment of the present invention provides a suspension device for an outboard motor, including a steering shaft, a bracket, and at least one bearing. The steering shaft is to be connected to an outboard motor. The bracket defines a shaft insertion hole in which the steering shaft is inserted. The at least one bearing supports the steering shaft rotatably about a central axis of the steering shaft relative to the bracket. The at least one bearing includes a tubular metal portion held by the bracket and surrounding the steering shaft, and a resin layer held at the inner periphery of the metal portion and including a sliding surface that slides in contact with an outer peripheral surface of the steering shaft. The bracket into which the steering shaft is inserted may preferably be a swivel bracket connected via a tilting shaft to a clamp bracket that is attachable to a hull, or may preferably be a transom bracket that is attachable to a hull.

According to this arrangement, the steering shaft to be connected to an outboard motor is inserted in the shaft insertion hole of the bracket. The steering shaft is supported by the bracket rotatably via the at least one bearing. The bearing includes a tubular metal portion held by the bracket and a resin layer held at the inner periphery of the metal portion. The metal portion surrounds the steering shaft. The resin layer includes a sliding surface that slides in contact with an outer peripheral surface of the steering shaft. Therefore, the steering shaft slides in contact with the resin layer while rotating about a central axis of the steering shaft relative to the bracket.

The metal portion is preferably made of a metal material having a higher strength than that of a resin material. Therefore, the amount of elastic deformation of the bearing is kept small, and rattling of the steering shaft is significantly reduced. Further, because the metal material has a higher dimensional accuracy than that of resin, a clearance between the outer peripheral surface of the steering shaft and the sliding surface can be precisely controlled. Accordingly, not only can manufacturing variations of the steering shaft be further reduced, but wear of an upper bearing and lower bearing can also be significantly reduced. Moreover, because the resin layer that slides in contact with the steering shaft is layered and thinner than the metal portion, an amount of movement of the steering shaft due to elastic deformation of the resin layer is small. Thus, a steering operation for the outboard motor can be controlled with high accuracy.

In the fourth preferred embodiment of the present invention, the bracket is preferably made of the same type of metal material as that of the metal portion. In this case, the metal material preferably is an aluminum alloy, for example.

Moreover, in the fourth preferred embodiment of the present invention, the resin layer is preferably made of a fluorine-contained resin, for example.

Moreover, in the fourth preferred embodiment of the present invention, the metal portion is preferably press-fitted in the shaft insertion hole, for example.

Moreover, in the fourth preferred embodiment of the present invention, the steering shaft preferably extends in the up-down direction. In this case, the at least one bearing preferably includes an upper bearing supporting an upper end portion of the steering shaft and a lower bearing supporting a lower end portion of the steering shaft.

Moreover, in the fourth preferred embodiment of the present invention, the suspension device preferably further includes an upper seal attached to the steering shaft at a height higher than that of the upper bearing and a lower seal attached to the steering shaft at a height lower than that of the lower bearing. The upper seal may preferably be an oil seal or an O-ring, for example. The same applies to the lower seal. Entry of water into the shaft insertion hole is prevented by the upper seal and the lower seal.

Moreover, in the fourth preferred embodiment of the present invention, the suspension device preferably further includes an upper mount support portion disposed at a height higher than that of the upper seal, and attached to the outboard motor via an upper mount, and a lower mount support portion disposed at a height lower than that of the lower seal, and attached to the outboard motor via a lower mount. The upper mount support portion is preferably arranged to rotate about a central axis of the steering shaft together with the steering shaft. Similarly, the lower mount support portion is preferably arranged to rotate about a central axis of the steering shaft together with the steering shaft.

Moreover, in the fourth preferred embodiment of the present invention, the suspension device preferably further includes an arm cover in which an upper end portion of the steering shaft is inserted, and that covers the bracket. The upper seal is preferably press-fitted in the arm cover to seal an area between an upper end portion of the steering shaft and the arm cover.

Moreover, in the fourth preferred embodiment of the present invention, the suspension device preferably further includes an electric steering mechanism that causes the steering shaft to rotate about a central axis of the steering shaft together with the steering shaft.

Moreover, in the fourth preferred embodiment of the present invention, the suspension device preferably further includes a steering arm connected to the steering shaft, and rotating about a central axis of the steering shaft together with the steering shaft. In this case, the bracket preferably further includes an arm housing portion housing the steering arm.

A fifth preferred embodiment of the present invention provides a vessel prolusion apparatus including the suspension device according to any one of the first to fourth preferred embodiments of the present invention, and an outboard motor connected to the steering shaft of the suspension device.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
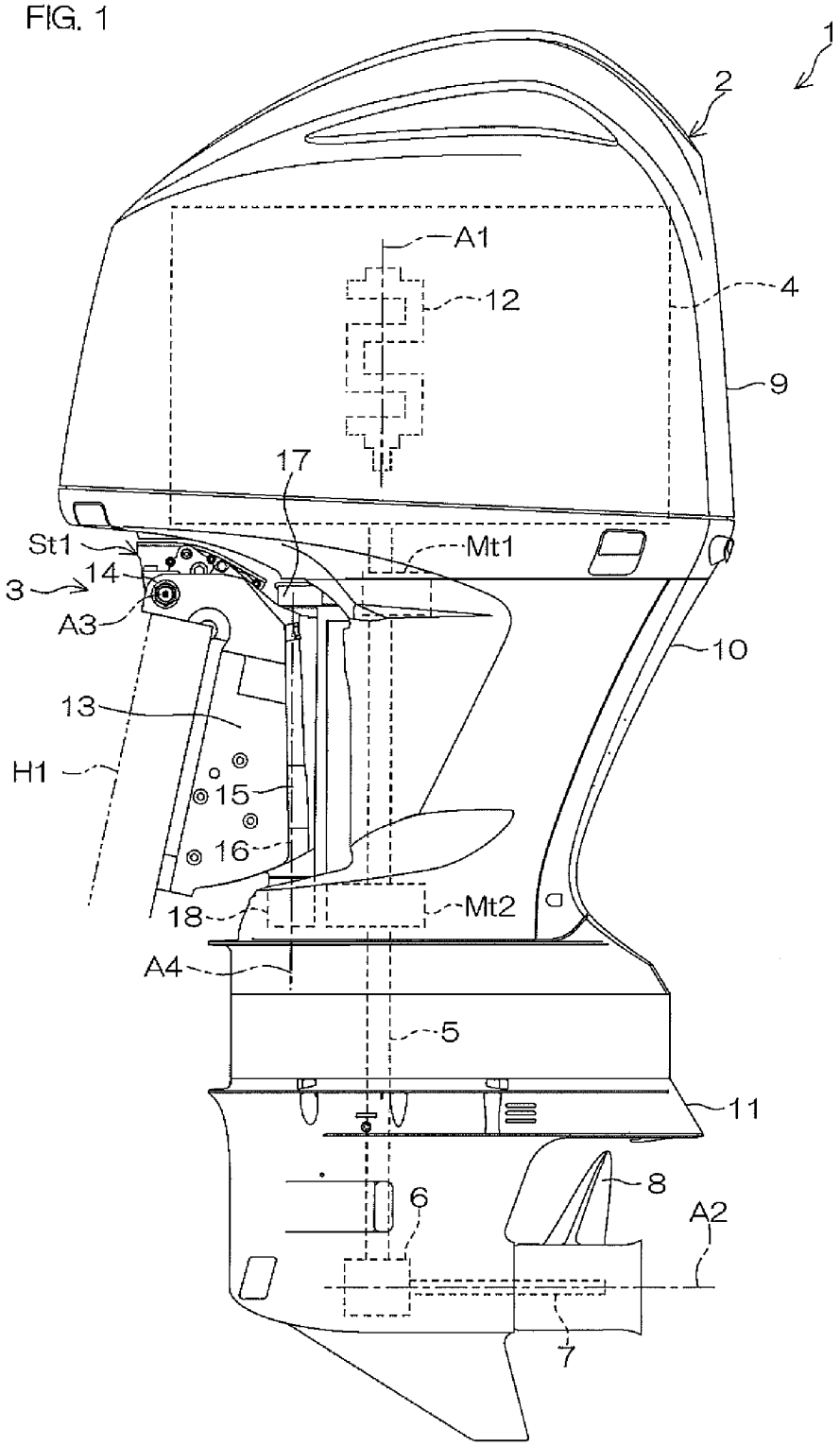
FIG. 1 is side view of a vessel propulsion apparatus according to a preferred embodiment of the present invention.
Figure 2:
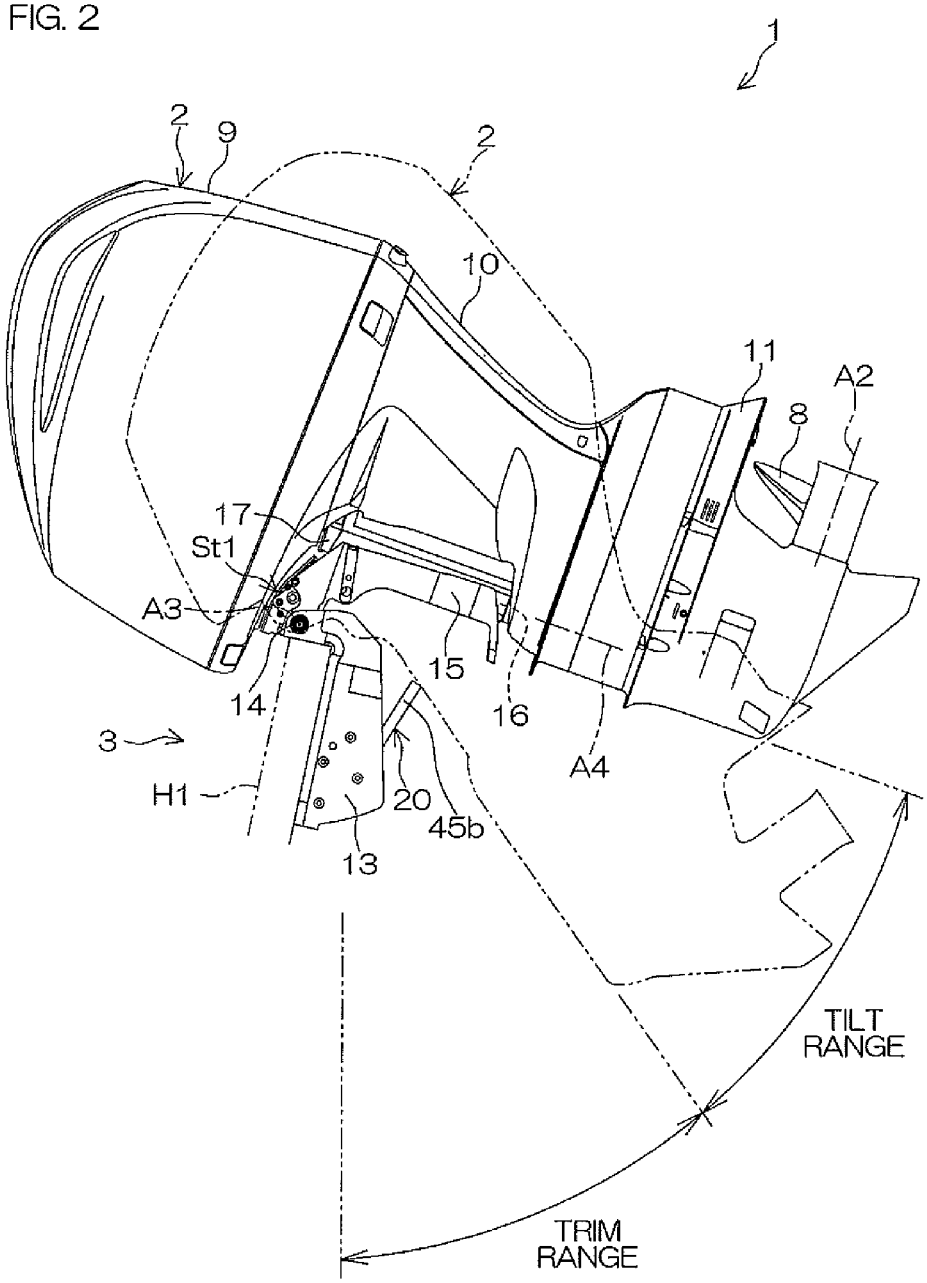
FIG. 2 is side view of a vessel propulsion apparatus according to a preferred embodiment of the present invention.
Figure 3:
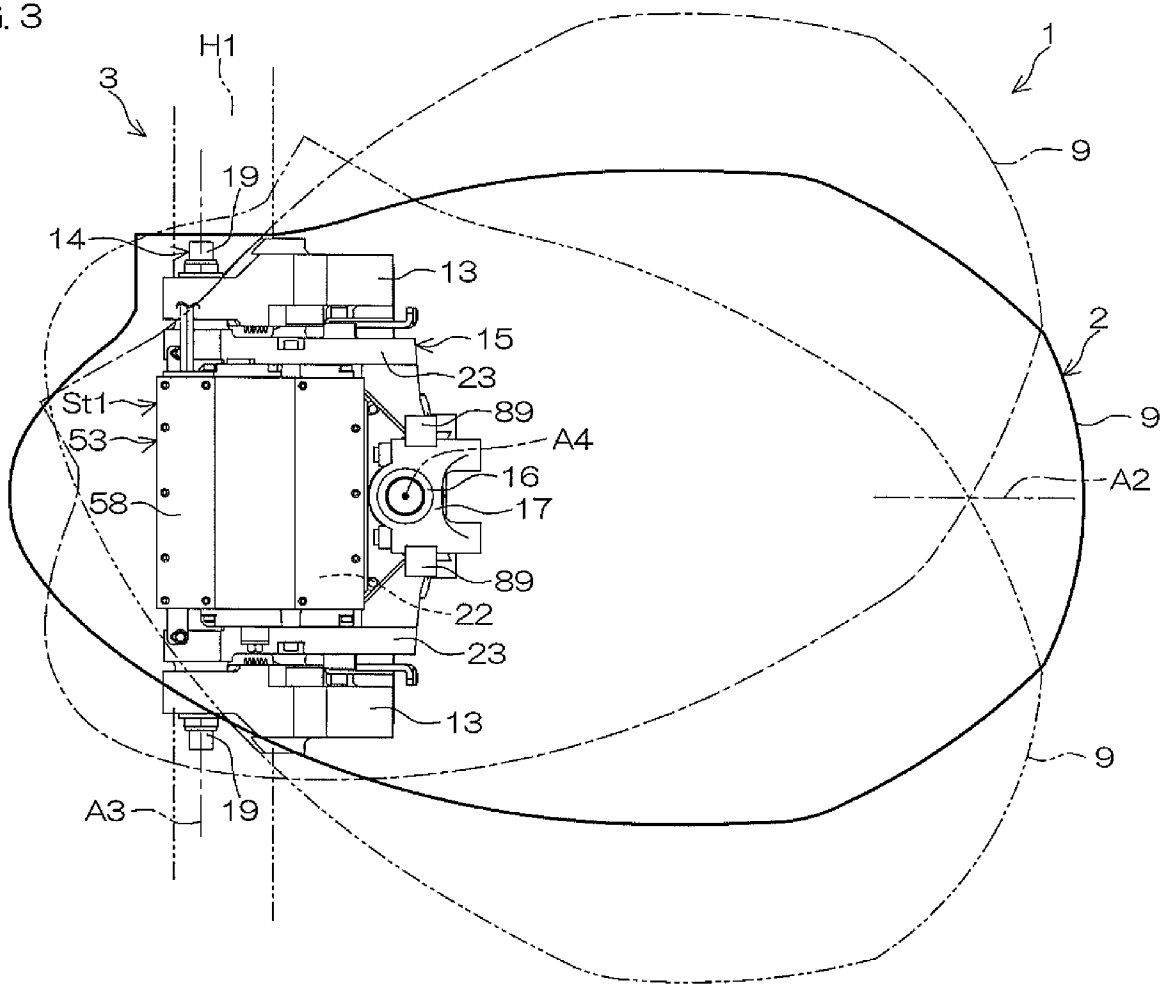
FIG. 3 is a plan view of a suspension device according to a preferred embodiment of the present invention.
Figure 4:
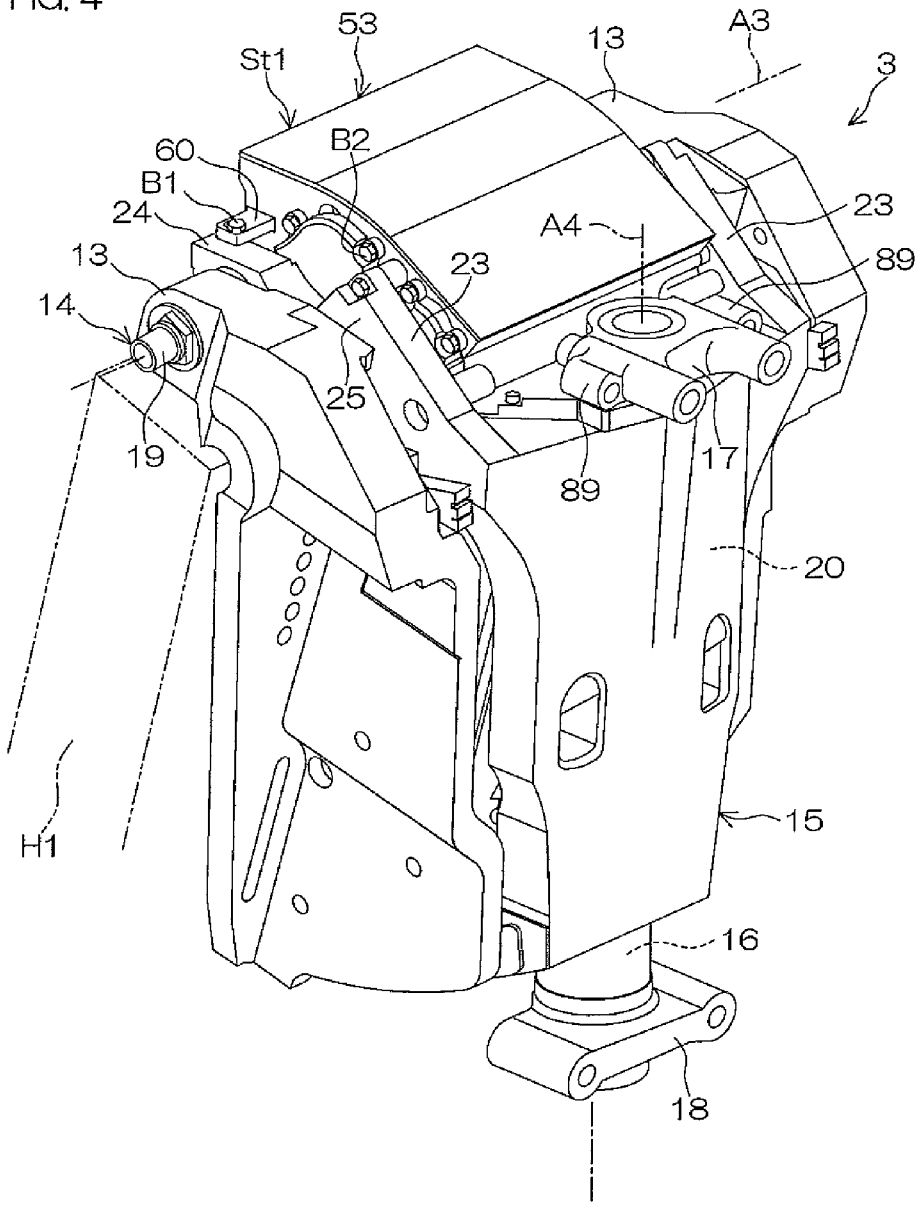
FIG. 4 is a perspective view of a suspension device according to a preferred embodiment of the present invention.

FIG. 1 and FIG. 2 are side views of a vessel propulsion apparatus 1 according to a preferred embodiment of the present invention. FIG. 3 is a plan view of a suspension device 3 according to a preferred embodiment of the present invention, and FIG. 4 is a perspective view of a suspension device 3 according to a preferred embodiment of the present invention.

FIG. 1 shows the vessel propulsion apparatus 1 in a reference state, and FIG. 2 shows the vessel propulsion apparatus 1 in a full tilt-up state by solid lines. FIG. 3 and FIG. 4 show the suspension device 3 in a reference state. The reference state is a state where a rotation axis (a crank axis A1) of a crankshaft 12 extends in an up-down direction and a rotation axis (a propeller axis A2) of a propeller 8 extends in a front-rear direction. The "front-rear direction," "left-right direction," "up-down direction" in the following description refer to directions of the vessel propulsion apparatus 1 in a reference state. In the following, unless otherwise specified, description will be given of the vessel propulsion apparatus 1 in a reference state.

As shown in FIG. 1, the vessel propulsion apparatus 1 includes an outboard motor 2 that produces thrust and a suspension device 3 that supports the outboard motor 2. The suspension device 3 is attachable to a rear portion of a hull H1. The outboard motor 2 is attached to the rear portion of the hull H1 via the suspension device 3. As to be described later, the suspension device 3 includes either one of an electric steering mechanism St1 and a hydraulic steering mechanism St2. First, description will be given of the case where the suspension device 3 includes an electric steering mechanism St1, and then description will be given of the case where the suspension device 3 includes a hydraulic steering mechanism St2.

As shown in FIG. 1, the outboard motor 2 includes an engine 4 that produces power, a drive shaft 5 connected to the engine 4, a gear unit 6 connected to the drive shaft 5, and a propeller shaft 7 connected to the gear unit 6. The outboard motor 2 further includes an engine cover 9 that houses the engine 4, an upper case 10 disposed below the engine cover 9, and a lower case 11 disposed below the upper case 10.

As shown in FIG. 1, the engine 4 preferably is an internal combustion engine including a crankshaft 12 that is rotatable about a crank axis A1 extending in the up-down direction. The drive shaft extends in the up-down direction below the engine 4. The gear unit 6 is connected to a lower end portion of the drive shaft 5. A front end portion of the propeller shaft 7 is connected to the gear unit 6. The propeller shaft 7 extends in the front-rear direction in the lower case 11. The propeller shaft 7 is rotatable relative to the lower case 11 about a propeller axis A2 (a central axis of the propeller shaft 7) extending in the front-rear direction. A rear end portion of the propeller shaft 7 projects rearward from the lower case 11. A propeller 8 is attached to the rear end portion of the propeller shaft 7. The propeller 8 rotates about the propeller axis A2 together with the propeller shaft 7. A rotation of the crankshaft 12 is transmitted to the propeller 8 via the drive shaft 5, the gear unit 6, and the propeller shaft 7, in order. When the engine 4 rotationally drives the propeller 8 in a normal rotation direction (for example, a clockwise direction when the propeller 8 is viewed from behind), thrust to propel the hull H1 forward is produced, and when the engine 4 rotationally drives the propeller 8 in a reverse rotation direction (a direction opposite to the normal rotation direction), thrust to propel the hull H1 rearward is produced.

As shown in FIG. 4, the suspension device 3 includes a pair of clamp brackets 13 that are attachable to a rear portion of the hull H1, a tilting shaft 14 connected to the pair of clamp brackets 13, a swivel bracket 15 connected to the tilting shaft 14, and a steering shaft 16 held by the swivel bracket 15. The suspension device 3 further includes an upper mount support portion 17 fixed to an upper end portion of the steering shaft 16 and a lower mount support portion 18 fixed to a lower end portion of the steering shaft 16. As shown in FIG. 1, the outboard motor 2 includes an upper mount Mt1 and a lower mount Mt2 disposed in the interior of the outboard motor 2. The upper mount Mt1 and the lower mount Mt2 are disposed at mutually different positions. The upper mount Mt1 is fixed to the upper mount support portion 17 preferably by a bolt, and the lower mount Mt2 is fixed to the lower mount support portion 18 preferably by a bolt, for example. Thus, the outboard motor 2 is fixed to the steering shaft 16 at the two upper and lower sites.

As shown in FIG. 3, the width of the suspension device 3 is narrower than that of the outboard motor 2. The pair of clamp brackets 13 are removably attached to a transom provided in the stern. The pair of clamp brackets 13 are disposed at an interval in the left-right direction. The pair of clamp brackets 13 are disposed closer to the center of the outboard motor 2 in the width direction than the right end and left end of the outboard motor 2. The tilting shaft 14 is connected to an upper portion of each clamp bracket 13. The tilting shaft 14 is disposed above the transom. The tilting shaft 14 extends in the left-right direction. The tilting shaft 14 includes two divided shafts 19 disposed on a tilt axis A3 (a central axis of the tilting shaft 14) extending in the left-right direction (refer to FIG. 5). The two divided shafts 19 are disposed at an interval in the left-right direction. The two divided shafts 19 are fixed to the swivel bracket 15.

As shown in FIG. 4, the swivel bracket 15 is disposed between the pair of clamp brackets 13. The swivel bracket 15 is connected to the clamp brackets 13 via the two divided shafts 19. The swivel bracket 15 is rotatable up and down relative to the clamp brackets 13 about the tilt axis A3. The steering shaft 16 is rotatably held by the swivel bracket 15. The steering shaft 16 extends in the up-down direction. The steering shaft 16 is rotatable relative to the swivel bracket 15 about a steering axis A4 (a central axis of the steering shaft 16) extending in the up-down direction. As previously described, the outboard motor 2 is connected to the steering shaft 16 via the upper mount Mt1 and the lower mount Mt2. Therefore, the outboard motor 2 turns left and right about the steering axis A4 relative to the swivel bracket 15 together with the steering shaft 16. Moreover, the outboard motor 2 turns up and down about the tilt axis A3 relative to the clamp brackets 13 together with the swivel bracket 15 and the steering shaft 16.

As shown in FIG. 2, the suspension device 3 includes a power trim/tilt mechanism (hereinafter, referred to as a "PTT 20") that causes the outboard motor 2 to turn up and down about the tilt axis A3. The PTT 20 is disposed between the pair of clamp brackets 15. The PTT 20 is connected to the clamp brackets 13 and the swivel bracket 15. The PTT 20 causes the swivel bracket 15 to turn up and down about the tilt axis A3 relative to the clamp brackets 13. Accordingly, the outboard motor 2 turns up and down about the tilt axis A3.

As shown in FIG. 2, the PTT 20 causes the outboard motor 2 to turn up and down within a predetermined range including a trim range and a tilt range. The trim range is a range continuous to the tilt range, where the tilt angle of the outboard motor 2 toward the front and rear is smaller than that in the tilt range. The trim range is a range between a full trim-in angle and a full trim-out angle, and the tilt range is a range between a full trim-out angle and a full tilt-up angle. In FIG. 2, the outboard motor 2 in a full trim-up state (a state where the tilt angle is a full trim-out angle) is shown by alternate long and two short dashed lines, and the outboard motor 2 in a full tilt-up state (a state where the tilt angle is a full tilt-up angle)

is shown by solid lines. The PTT 20 is capable of holding the outboard motor 2 at an arbitrary position in the trim range and tilt range.

As shown in FIG. 3, the suspension device 3 preferably further includes an electric steering mechanism St1 that causes the outboard motor 2 to turn left and right about the steering axis A4. The electric steering mechanism St1 is held by the swivel bracket 15. The electric steering mechanism St1 is connected to the steering shaft 16. The electric steering mechanism St1 causes the steering shaft 16 to turn left and right about the steering axis A4 relative to the swivel bracket 15. Accordingly, the outboard motor 2 turns left and right about the steering axis A4.

As shown in FIG. 3, the outboard motor 2 is turnable left and right between a maximum right turning position and a maximum left turning position. In FIG. 3, the outline of the engine cover 9 at the maximum right turning position is shown by an alternate long and short dashed line, and the outline of the engine cover 9 at the maximum left turning position is shown by an alternate long and two short dashed line. The maximum right turning position and the maximum left turning position are positions where the outboard motor 2 tilts left and right. The maximum right turning position and the maximum left turning position are in a left-right symmetrical positional relationship. The electric steering mechanism St1 causes the outboard motor 2 to turn left and right from a central position located midway between the maximum right turning position and the maximum left turning position. The central position is a position where the propeller axis A2 perpendicularly or substantially perpendicularly intersects the tilt axis A3 in a plan view, and extends in the front-rear direction in a plan view. In FIG. 3, the outline of the engine cover 9 at a straight drive position is shown by a solid line. The electric steering mechanism St1 is capable of holding the outboard motor 2 at an arbitrary position from the maximum right turning position to the maximum left turning position.

Figure 5:
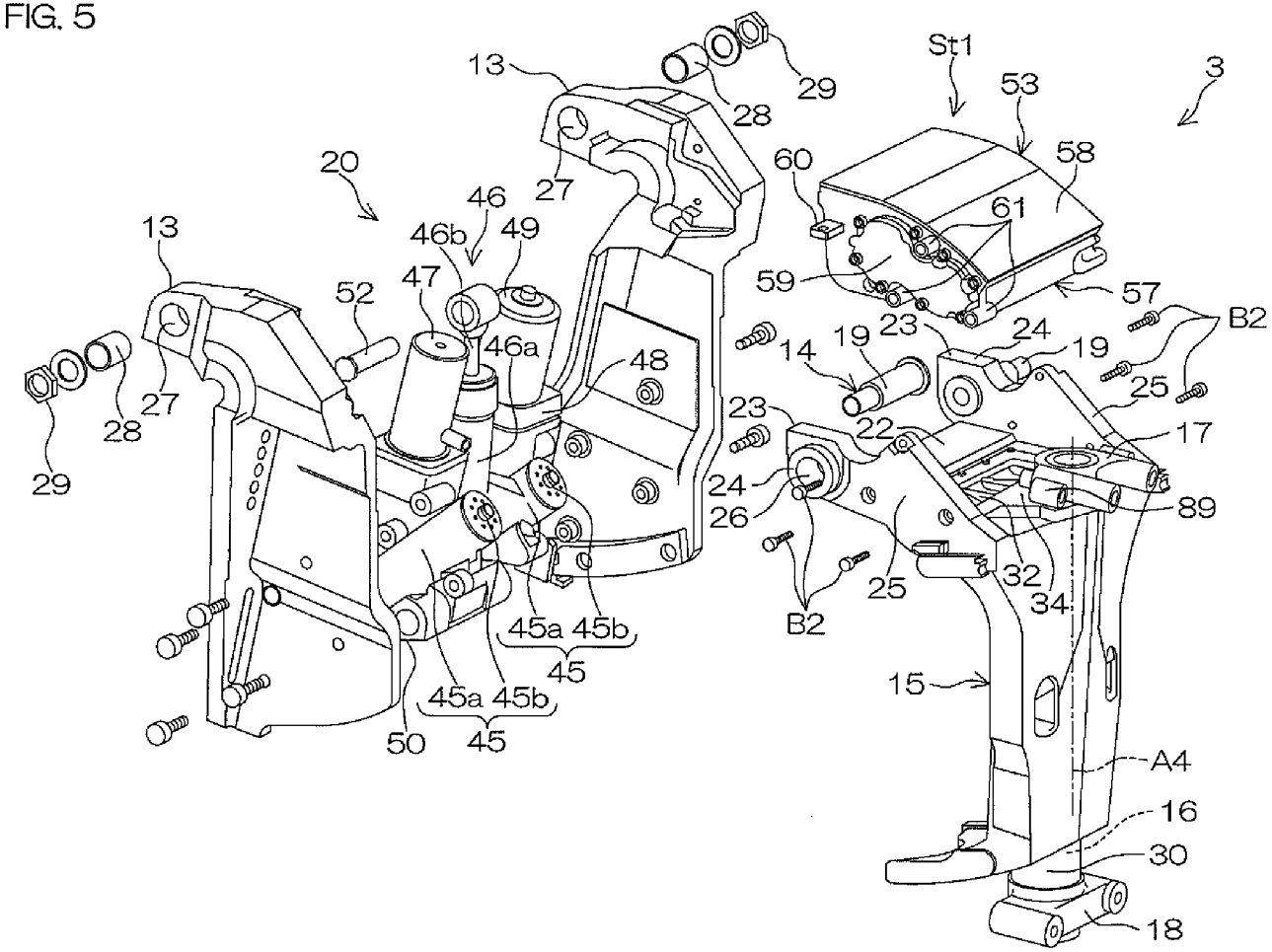
FIG. 5 is an exploded perspective view of the suspension device according to a preferred embodiment of the present invention.
Figure 6:
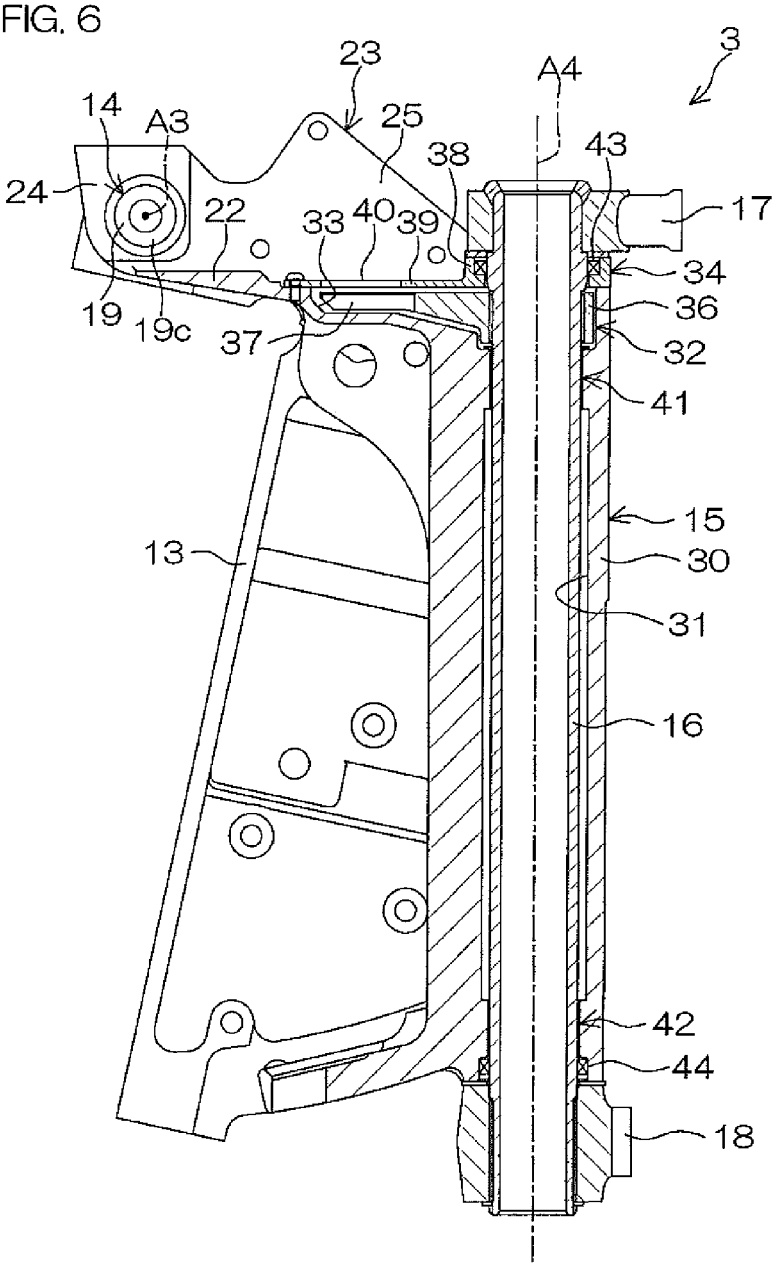
FIG. 6 is a longitudinal sectional view of the suspension device with the electric steering mechanism removed.
Figure 7:
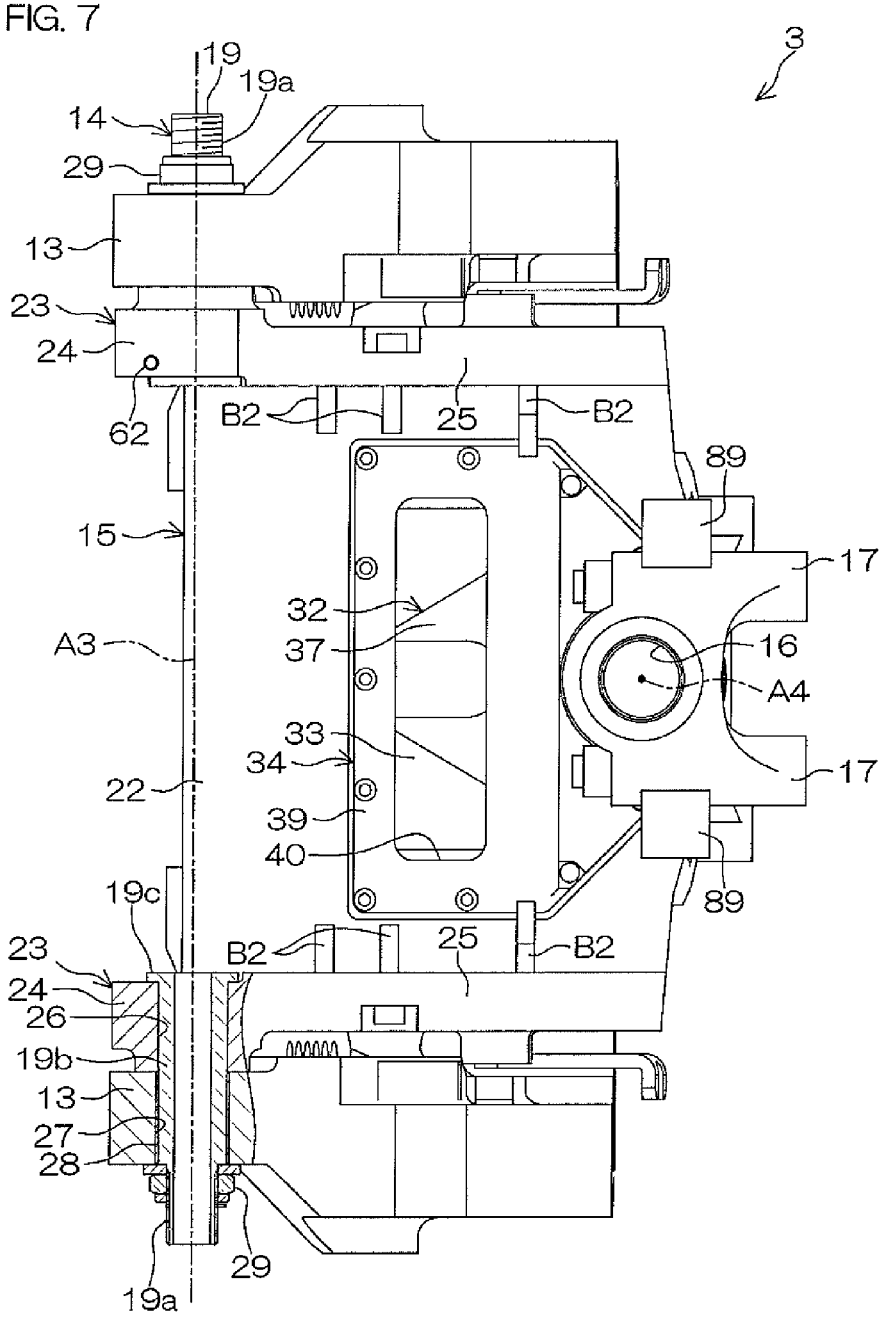
FIG. 7 is a plan view of the suspension device with the electric steering mechanism removed.
Figure 8:
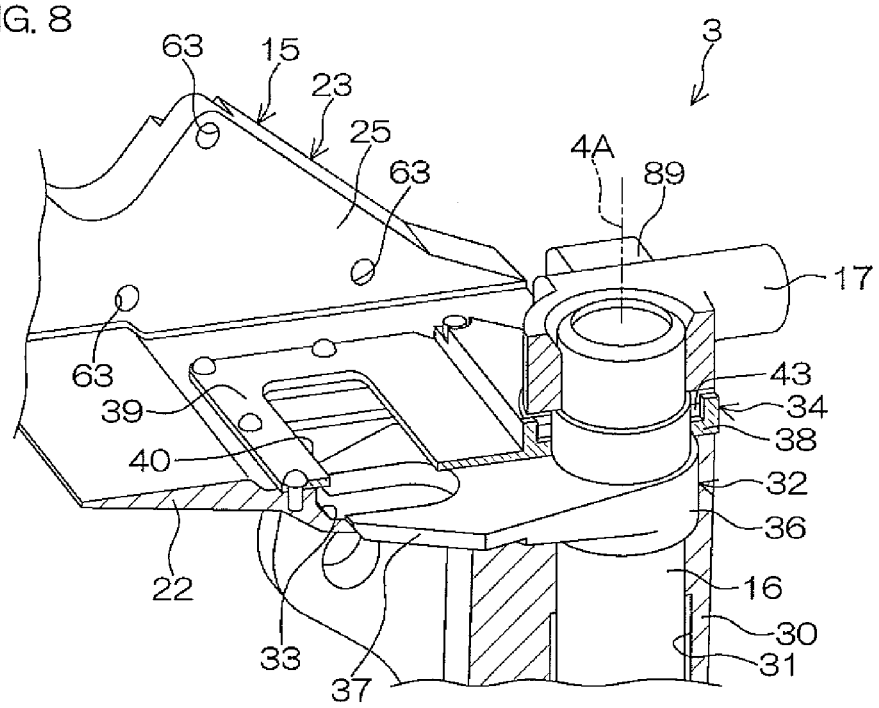
FIG. 8 is a sectional view showing a state where the steering shaft is attached to the swivel bracket.
Figure 9:
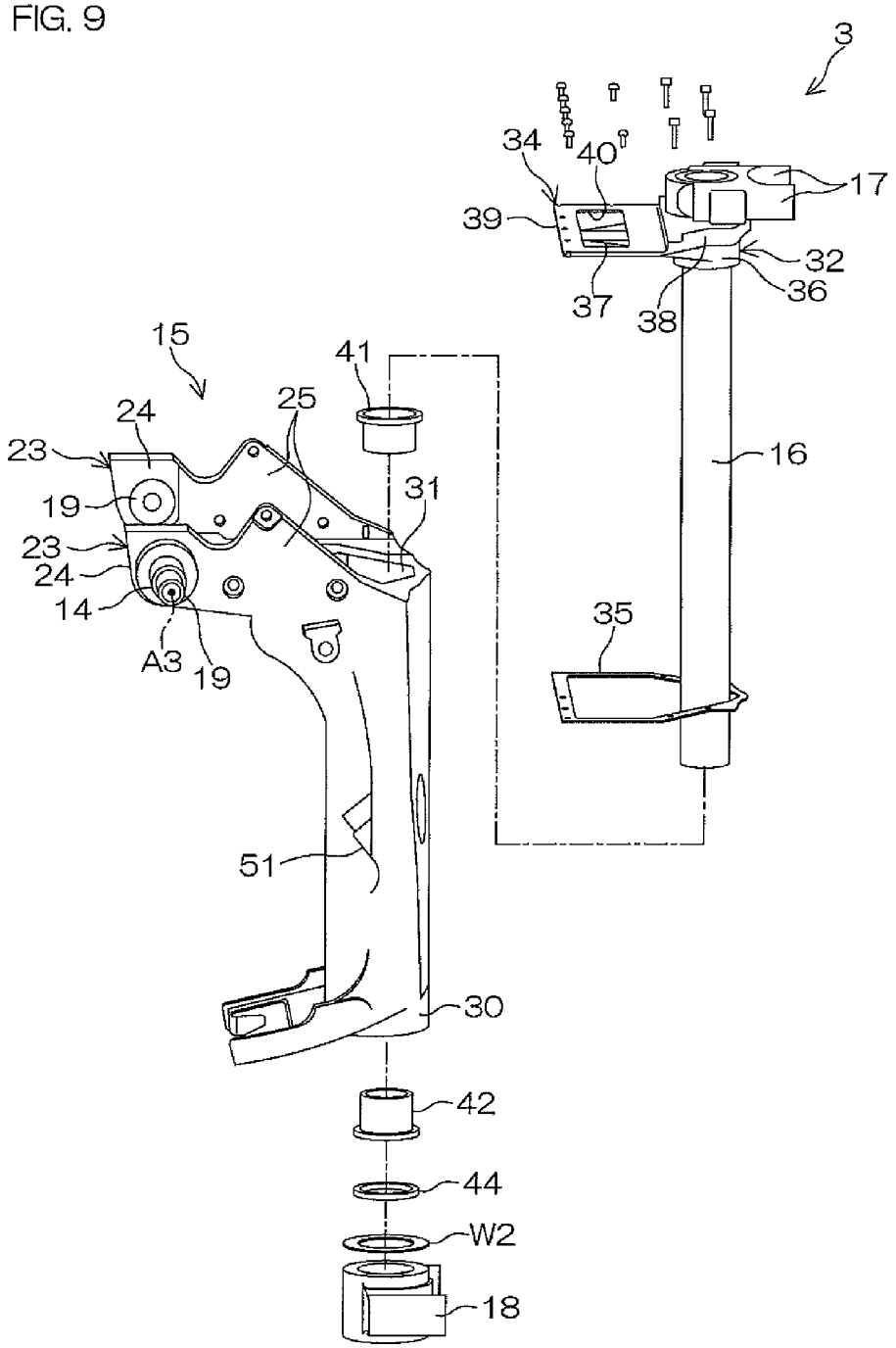
FIG. 9 is an exploded perspective view showing a state before the steering shaft is attached to the swivel bracket.
Figure 10:
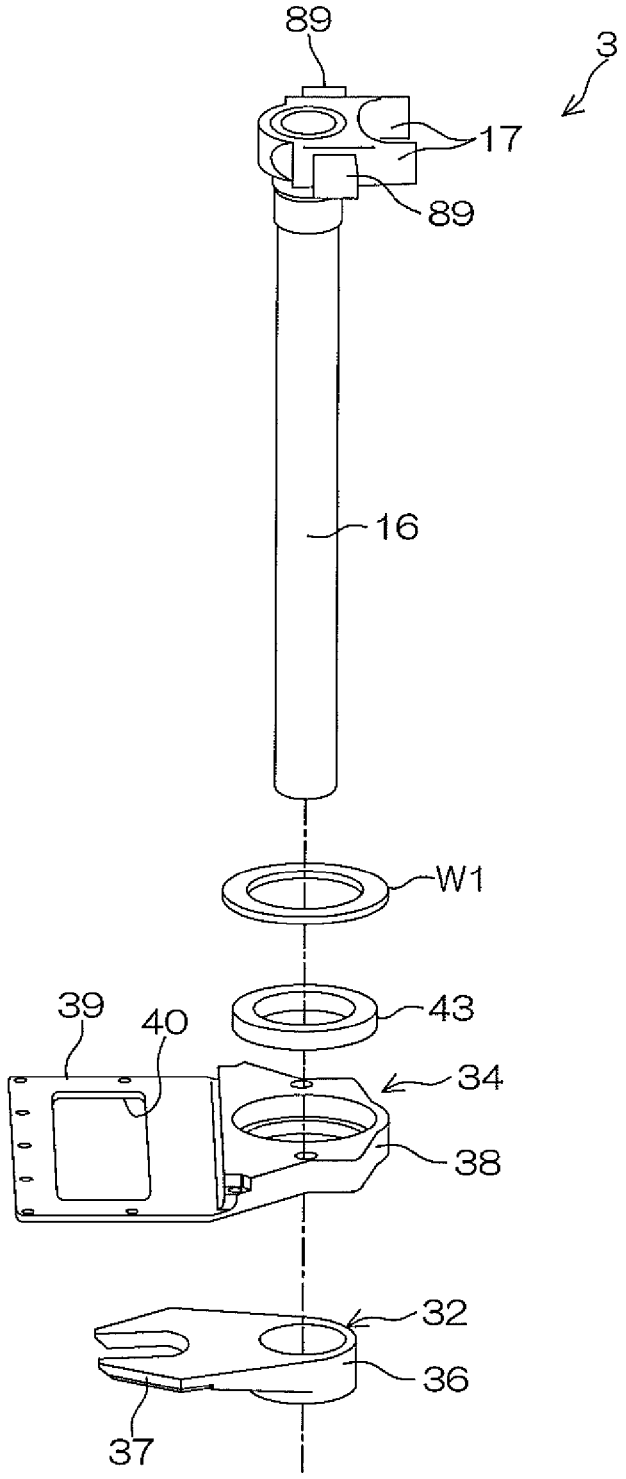
FIG. 10 is an exploded perspective view showing a state before a first steering arm and an arm cover are attached to the steering shaft.

FIG. 5 is an exploded perspective view of the suspension device 3. FIG. 6 is a longitudinal sectional view of the suspension device 3 with the electric steering mechanism St1 removed, FIG. 7 is a plan view of the suspension device 3 with the electric steering mechanism St1 removed, FIG. 8 is a sectional view showing a state where the steering shaft 16 is attached to the swivel bracket 15, and FIG. 9 is an exploded perspective view showing a state before the steering shaft 16 is attached to the swivel bracket 15. FIG. 10 is an exploded perspective view showing a state before a first steering arm 32 and an arm cover 34 are attached to the steering shaft 16.

As shown in FIG. 5, the swivel bracket 15 includes a plate-shaped placing portion 22 kept in a horizontal posture and a pair of wall portions 23 disposed on both left and right sides of the placing portion 22. The right wall portion 23 extends upward from a right end portion of the placing portion 22, and the left wall portion 23 extends upward from a left end portion of the placing portion 22. The right wall portion 23 extends in the front-rear direction along the right end portion of the placing portion 22, and the left wall portion 23 extends in the front-rear direction along the left end portion of the placing portion 22. As shown in FIG. 7, a front end portion of the placing portion 22 and front end portions of the wall portions 23 are disposed above the transom. The pair of wall portions 23 are opposed to each other in parallel or substantially parallel at an interval in the left-right direction. The right wall portion 23 is disposed inside of the right clamp bracket 13, and the left wall portion 23 is disposed inside of the left clamp bracket 13. The right wall portion 23 and the right clamp bracket 13 are adjacent to each other in the left-right direction, and the left wall portion 23 and the left clamp bracket 13 are adjacent to each other in the left-right direction.

As shown in FIG. 7, each of the wall portions 23 includes a shaft support portion 24 that supports the divided shaft 19 and a case attaching portion 25 to which the electric steering mechanism St1 is attached. The right divided shaft 19 penetrates through the right shaft support portion 24 and the right clamp bracket 13 in the left-right direction. Similarly, the left divided shaft 19 penetrates through the left shaft support portion 24 and the left clamp bracket 13 in the left-right direction. The divided shafts 19 have tubular shapes extending in the left-right direction. Each of the divided shafts 19 preferably includes a screw portion 19*a*, a shaft portion 19*b* larger in diameter than the screw portion 19*a*, and a flange portion 19*c* larger in diameter than the shaft portion 19*b*. The screw portion 19*a*, the shaft portion 19*b*, and the flange portion 19*c* are disposed in this order from the outside.

As shown in FIG. 7, the shaft portion 19*b* is inserted in an inner insertion hole 26 that penetrates through the wall portion 23 in the left-right direction. Further, the shaft portion 19*b* is inserted in an outer insertion hole 27 that penetrates through the clamp bracket 13 in the left-right direction. The shaft portion 19*b* is fixed to the wall portion 23 by, for example, press fitting. Therefore, the tilting shaft 14 is fixed to the swivel bracket 15. The shaft portion 19*b* may be fixed to the wall portion 23 by bolting and/or welding, without limitation to press fitting, and may be fixed to the wall portion 23 by a fixing method other than the above methods, for example. The shaft portion 19*b* is inserted inside a tubular tilt bushing 28 press-fitted in the outer insertion hole 27. The shaft portion 19*b* is rotatable about the tilt axis A3 relative to the tilt bushing 28. Therefore, the clamp bracket 13 rotatably supports the tilting shaft 14 via the tilt bushing 28.

As shown in FIG. 7, the flange portion 19*c* is disposed inside of the wall portion 23. The flange portion 19*c* extends outward from an end portion of the shaft portion 19*b*. The outer diameter of the flange portion 19*c* is larger than the diameter of the inner insertion hole 26. The flange portion 19*c* is in contact with an inner surface of the wall portion 23. A movement to the outside of the divided shaft 19 relative to the wall portion 23 is restricted by contact between the wall portion 23 and the flange portion 19*c*. Moreover, the screw portion 19*a* is disposed outside of the clamp bracket 13. Dropout of the clamp bracket 13 from the divided shaft 19 is prevented by a nut 29 attached to the screw portion 19*a*.

As shown in FIG. 6, the swivel bracket 15 includes a shaft housing portion 30 that houses the steering shaft 16 rotatably about the steering axis A4. The shaft housing portion 30 extends downward from a rear end portion of the placing portion 22. The steering shaft 16 is inserted in a shaft insertion hole 31 that penetrates through the shaft housing portion 30 in the up-down direction. The steering shaft 16 projects upward from the upper end of the shaft insertion 31, and projects downward from the lower end of the shaft insertion hole 31. The upper mount support portion 17 is disposed above the shaft housing portion 30, and the lower mount support portion 18 is disposed below the shaft housing portion 30. The upper mount support portion 17 is fixed to an upper end portion of the steering shaft 16, and the lower mount support portion 18 is fixed to a lower end portion of the steering shaft 16.

As shown in FIG. 8, the suspension device 3 includes a first steering arm 32 connected to the steering shaft 16 at a height lower than that of the upper mount Mt1. The first steering arm 32 extends forward from an upper portion of the steering shaft 16. The first steering arm 32 is fixed to the steering shaft 16. Therefore, the first steering arm 32 turns about the steering axis A4 together with the steering shaft 16. The swivel bracket 15 includes a recessed arm housing portion 33 that is depressed downward from an upper surface of the placing portion 22. The first steering arm 32 is housed in the arm housing portion 33. Therefore, the first steering arm 32 is disposed in the interior of the swivel bracket 15. The suspension device 3 includes a plate-shaped arm cover 34 that covers the arm housing portion 33. The arm cover 34 is disposed above the first steering arm 32. As shown in FIG. 9, the arm cover 34 and the swivel bracket 15 are connected via a second seal 35 (gasket) disposed between the arm cover 34 and the swivel bracket 15. The second seal 35 seals an area between a peripheral edge portion of the arm cover 34 and the swivel bracket 15.

As shown in FIG. 9 and FIG. 10, the first steering arm 32 includes an annular arm portion 36 in which the steering shaft 16 is inserted and a forked (e.g., two forks) arm portion 37 that extends outward from the annular arm portion 36. The arm cover 34 includes an annular cover portion 38 in which the steering shaft 16 is inserted and a plate portion 39 that extends outward from the annular cover portion 38. The annular arm portion 36 is fixed to the steering shaft 16. The annular arm portion 36 may be fixed to the steering shaft 16 by at least one fixing method of press fitting, bolting, and welding, and may be fixed to the steering shaft 16 by a fixing method other than the above methods, for example. The annular arm portion 36 rotates about the steering axis A4 together with the steering shaft 16. The arm portion 37 is disposed in front of the annular arm portion 36. The annular cover portion 38 is disposed between the upper mount support portion 17 and the annular arm portion 36. The plate portion 39 is disposed in front of the annular cover portion 38. As shown in FIG. 7, the plate portion 39 is fixed to the swivel bracket 15 preferably by a plurality of bolts, for example. The arm housing portion 33 is covered with the plate portion 39. The arm portion 37 is disposed below a second opening 40 that penetrates through the plate portion 39 in the up-down direction. The arm housing portion 33 communicates with an area above the arm cover 34 via the second opening 40.

Figure 11:
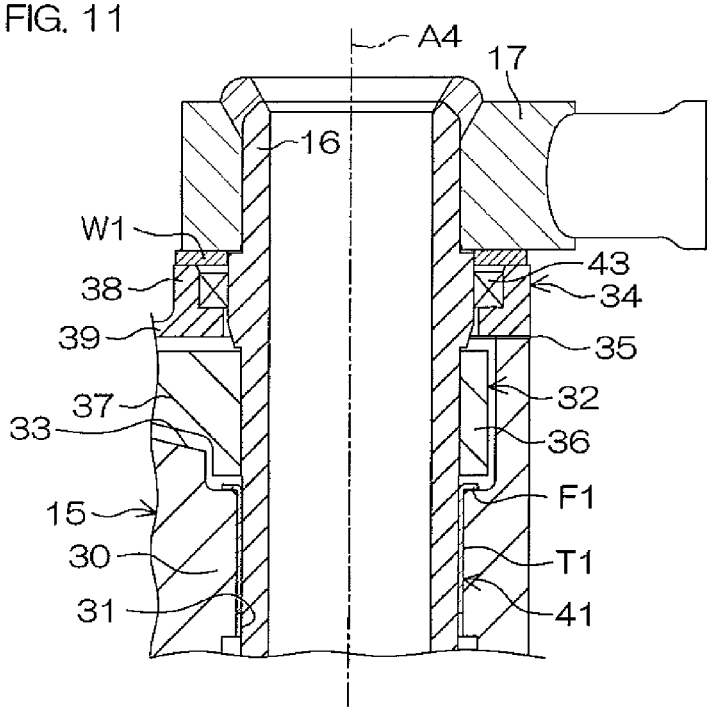
FIG. 11 is a view enlarged in an upper portion of FIG. 6.
Figure 12:
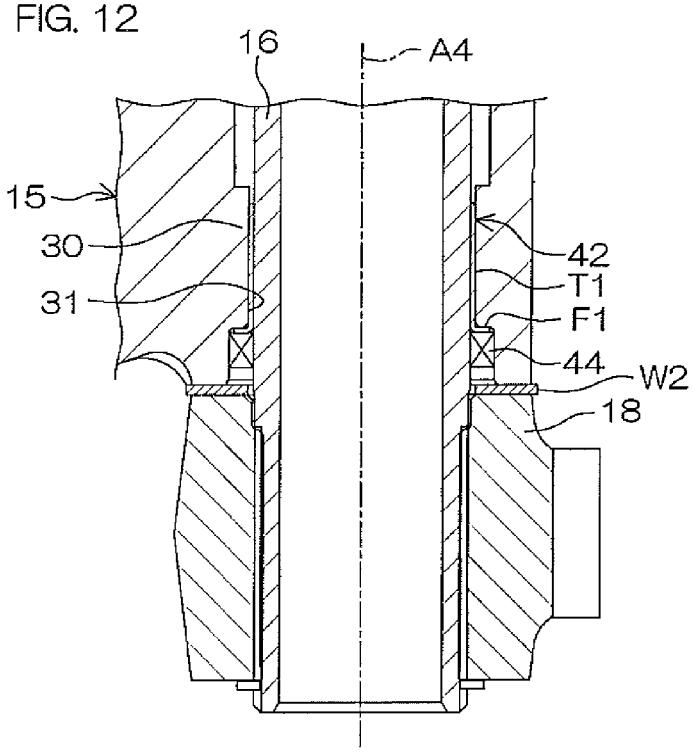
FIG. 12 is a view enlarged in a lower portion of FIG. 6.
Figure 13:
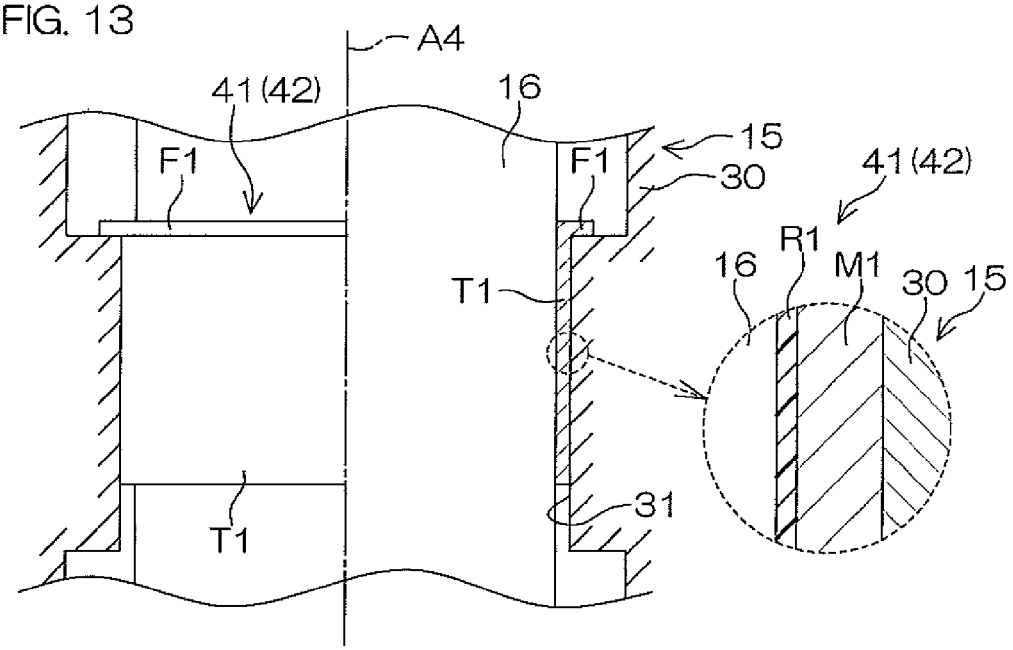
FIG. 13 is a partial sectional view of an upper bearing and a lower bearing.

FIG. 11 is a view enlarged in an upper portion of FIG. 6, and FIG. 12 is a view enlarged in a lower portion of FIG. 6. FIG. 13 is a partial sectional view of an upper bearing 41 and a lower bearing 42.

As shown in FIG. 11, the suspension device 3 includes a tubular upper bearing 41 disposed inside the shaft insertion hole 31. As shown in FIG. 12, the suspension device 3 includes a tubular lower bearing 42 disposed inside the shaft insertion hole 31 at a position lower than that of the upper bearing 41. As shown in FIG. 11 and FIG. 12, the steering shaft 16 is inserted in the upper bearing 41 and the lower bearing 42. The upper bearing 41 supports an upper end portion of the steering shaft 16, and the lower bearing 42 supports a lower end portion of the steering shaft 16. The upper bearing 41 and the lower bearing 42 are held by the swivel bracket 15. Therefore, the steering shaft 16 is connected to the swivel bracket 15 via the upper bearing 41 and the lower bearing 42. The upper bearing 41 and the lower bearing 42 preferably are sliding bearings. The steering shaft 16 is rotatable about the steering axis A4 relative to the upper bearing 41 and the lower bearing 42.

As shown in FIG. 13, the upper bearing 41 and the lower bearing 42 include a tubular metal portion M1 and a resin layer R1 surrounding the steering shaft 16. The metal portion M1 includes a tubular portion T1 extending along the steering axis A4 and a flange portion F1 extending radially outward from an end portion of the tubular portion T1. The tubular portion T1 continues throughout the entire circumference. The tubular portion T1 is press-fitted inside the shaft insertion hole 31. Therefore, the metal portion M1 is held by the swivel bracket 15. The metal portion M1 is positioned in the axial direction of the steering shaft 16 by contact between the flange portion F1 and the swivel bracket 15. As shown in FIG. 11, the upper bearing 41 is held by the swivel bracket 15 in a posture with the flange portion F1 facing upward, and as shown in FIG. 12, the lower bearing 42 is held by the swivel bracket 15 in a posture with the flange portion F1 facing downward. As shown in FIG. 13, the resin layer R1 is coupled with the inner periphery of the tubular portion T1. The resin layer R1 is a coating layer that covers the inner periphery of the tubular portion T1, and the thickness of the coating layer (resin layer R1) is smaller than that of the tubular portion T1 (metal portion M1). The resin layer R1 includes a sliding surface that slides in contact with an outer peripheral surface of the steering shaft 16.

As shown in FIG. 13, the resin layer R1 preferably is made of a resin material having a lower strength than that of the steering shaft 16. The resin material may preferably be a fluorine-contained resin, and more preferably, PTFE (polytetrafluoroethylene resin), for example. Of course, the resin layer R1 may preferably be made of a resin material other than a fluorine-contained resin. On the other hand, the metal portion M1 is preferably made of a metal material having a higher strength than that of the resin layer R1. The metal material may preferably be a material containing aluminum as a main component such as an aluminum alloy, and may preferably be a material containing iron as a main component such as cast iron or carbon steel. Of course, the metal portion M1 may preferably be made of a metal material other than these materials. The swivel bracket 15 is preferably made of the same type of metal material as that of the metal portion M1. In this case, deterioration of a contact portion between the swivel bracket 15 and the metal portion M1 due to electrolytic corrosion can be prevented.

As shown in FIG. 11, the suspension device 3 includes an annular upper seal 43 disposed inside the annular cover portion 38. As shown in FIG. 12, the suspension device 3 includes an annular lower seal 44 disposed inside the shaft insertion hole 31. The upper seal 43 may preferably be an oil seal or an O-ring, for example. The same applies to the lower seal 44. The upper seal 43 is press-fitted inside the annular cover portion 38. The lower seal 44 is press-fitted inside the shaft housing portion 30. Therefore, the upper seal 43 is held by the arm cover 34, and the lower seal 44 is held by the swivel bracket 15. As shown in FIG. 11 and FIG. 12, the steering shaft 16 is inserted inside the upper seal 43 and the lower seal 44. The upper seal 43 is attached to the steering shaft 16 at a position higher than that of the upper bearing 41, and the lower seal 44 is attached to the steering shaft 16 at a position lower than that of the lower bearing 42. The upper mount support portion 17 is disposed at a position higher than that of the upper seal 43, and the lower mount support portion 18 is disposed at a position lower than that of the lower seal 44. A tubular upper washer W1 is disposed between the upper seal 43 and the upper mount support portion 17, and a tubular lower washer W2 is disposed between the lower seal 44 and the lower mount support portion 18.

As shown in FIG. 11 and FIG. 12, the upper seal 43 seals an area between the inner peripheral surface of the annular cover portion 38 and the outer peripheral surface of the steering shaft 16. Therefore, entry of water from above into the shaft insertion hole 31 is prevented by the upper seal 43. On the other hand, the lower seal 44 seals an area between the inner peripheral surface of the shaft housing portion 30 and the outer peripheral surface of the steering shaft 16. Therefore, entry of water from below into the shaft insertion hole 31 is prevented by the lower seal 44. The arm housing portion 33 communicates with the shaft insertion hole 31 (refer to FIG. 6). The peripheral edge portion of the arm cover 34 that covers the arm housing portion 33 and the swivel bracket 15 are sealed by the second seal 35 therebetween. Therefore, the second seal 35 prevents entry of water into the arm housing portion 33. Thus, entry of water into the shaft insertion hole 31 from the arm housing portion 33 is prevented.

Figure 14:
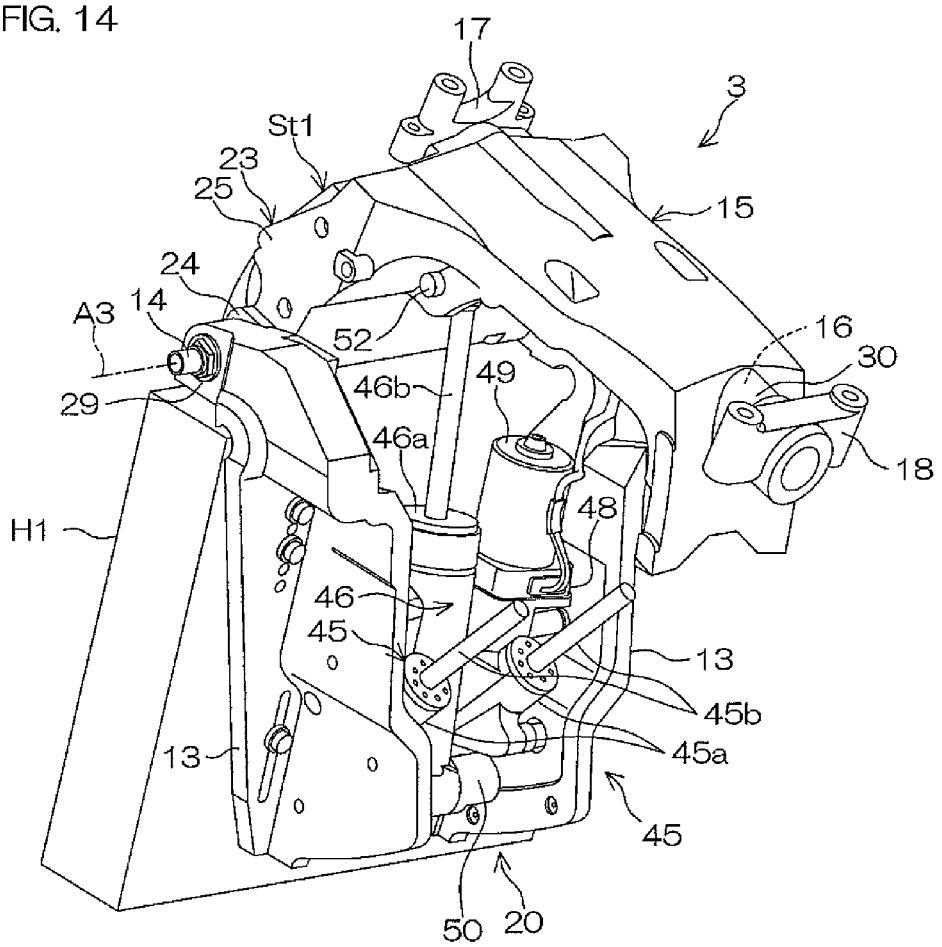
FIG. 14 is a perspective view of the suspension device in a full tilt-up state.
Figure 15:
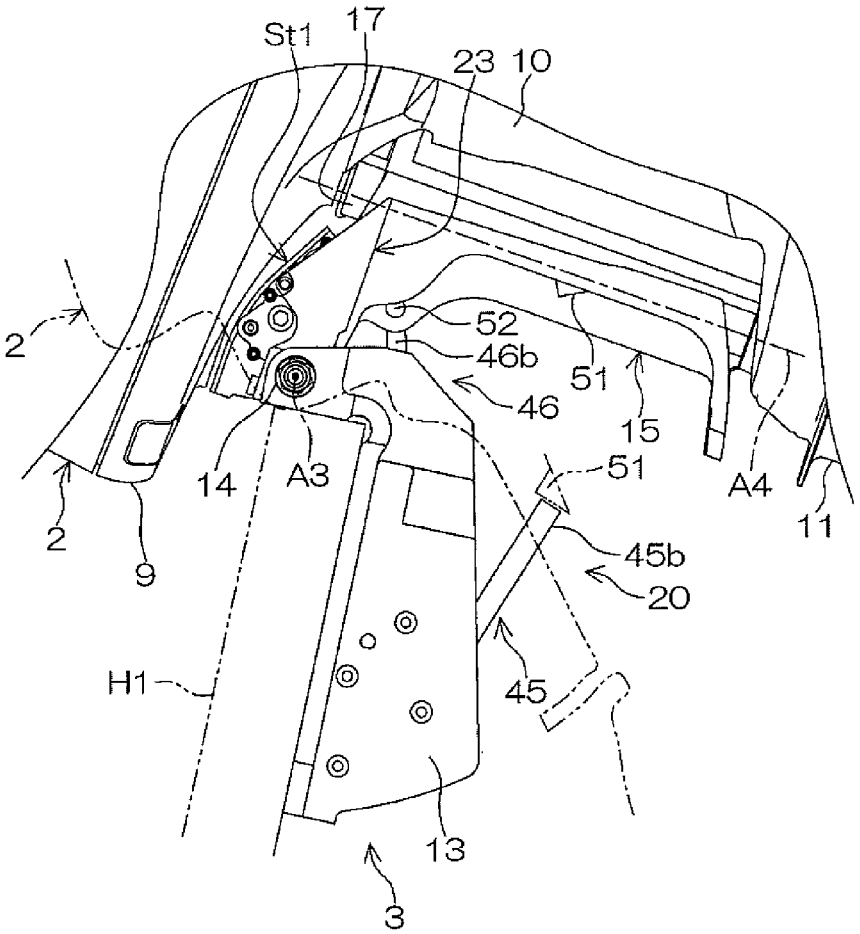
FIG. 15 is a side view of the suspension device in a full tilt-up state.

FIG. 14 is a perspective view of the suspension device 3 in a full tilt-up state, and FIG. 15 is a side view of the suspension device 3 in a full tilt-up state. In FIG. 15, the outboard motor 2 and the swivel bracket 15 in a full trim-out state are shown by alternate long and two short dashed lines.

As shown in FIG. 14, the PTT 20 preferably includes a plurality of cylinders (for example, two trim cylinders 45 and a tilt cylinder 46) that cause the outboard motor 2 to turn up and down. The trim cylinders 45 and the tilt cylinder 46 preferably are hydraulic cylinders, for example. The PTT 20 includes an oil tank 47 (refer to FIG. 5) that reserves a hydraulic oil, a hydraulic pump 48 that sends a hydraulic oil to the trim cylinders 45 and the tilt cylinder 46, and an electric motor 49 that drives the hydraulic pump 48. The trim cylinders 45, the tilt cylinder 46, the oil tank 47, the hydraulic pump 48, and the electric motor 49 are held by a frame 50 disposed between the pair of clamp brackets 13.

As shown in FIG. 14, the two trim cylinders 45 are disposed in parallel or substantially parallel at an interval in the left-right direction. Each trim cylinder 45 is tilted to the front and rear so that the upper end of the trim cylinder 45 is located closer to the rear than the lower end of the trim cylinder 45. The tilt cylinder 46 is disposed so that the tilt cylinder 46 is located between the two trim cylinders 45 when viewed in the front-rear direction. An upper end portion of the tilt cylinder 46 is disposed at a position higher than that of each trim cylinder 45. The hydraulic pump 48 and the electric motor 49 are disposed above one trim cylinder 45, and the oil tank 47 is disposed above the other trim cylinder 45. The electric motor 49 is disposed above the hydraulic pump 48.

As shown in FIG. 14, each trim cylinder 45 includes a cylinder main body 45*a* and a trim rod 45*b* that extend along a central axis of the trim cylinder 45. Similarly, the tilt cylinder 46 includes a cylinder main body 46*a* and a tilt rod 46*b* that extend along a central axis of the tilt cylinder 46. Each trim rod 45*b* projects upward from the upper end of the cylinder main body 45*a*. Each cylinder main body 45*a* is fixed to the frame 50. As shown by the alternate long and two short dashed lines in FIG. 15, in a full trim-out state, a contact portion 51 provided on the swivel bracket 15 is supported at the tip of each trim rod 45*b*. On the other hand, as shown in FIG. 14, the tilt rod 46*b* projects upward from the upper end of the cylinder main body 46*a*. An upper end portion of the tilt rod 46*b* is connected to the swivel bracket 15 via an upper pin 52 extending in the left-right direction. A lower end portion of the cylinder main body 46*a* is connected to the frame 50 via a lower pin (not shown) extending in the left-right direction. The tilt rod 46*b* is turnable about the upper pin 52 relative to the swivel bracket 15, and the cylinder main body 46*a* is turnable about the lower pin relative to the frame 50.

When the hydraulic pump 48 is driven by the electric motor 49, a hydraulic oil is supplied from the hydraulic pump 48 to at least either of the trim cylinders 45 and the tilt cylinder 46. When a hydraulic oil is supplied from the hydraulic pump 48 to the cylinder main body 45*a* of each trim cylinder 45, the amount of projection of each trim rod 45*b* changes. Similarly, when a hydraulic oil is supplied from the hydraulic pump 48 to the cylinder main body 46*a* of the tilt cylinder 46, the amount of projection of the tilt rod 46*b* changes.

As shown in FIG. 15, when the amount of projection of the tilt rod 46*b* increases, the swivel bracket 15 is pushed up by the tilt rod 46*b*, and the outboard motor 2 turns upward about the tilt axis A3. Moreover, when the amount of projection of the trim rod 45*b* increases in a state of the outboard motor 2 located in the trim range, the swivel bracket 15 is pushed up by the tilt rod 45*b*, and the outboard motor 2 turns upward about the tilt axis A3. The tilt cylinder 46 supports the outboard motor 2 within the trim range and tilt range. Moreover, the two trim cylinders 45 support the outboard motor 2 within the trim range. That is, when the tilt angle of the outboard motor 2 exceeds the full trim-out angle, the tip of each trim rod 45*b* separates from the contact portion 51 of the swivel bracket 15. Therefore, in the tilt range, the outboard motor 2 is supported by the tilt cylinder 46.

Figure 16:
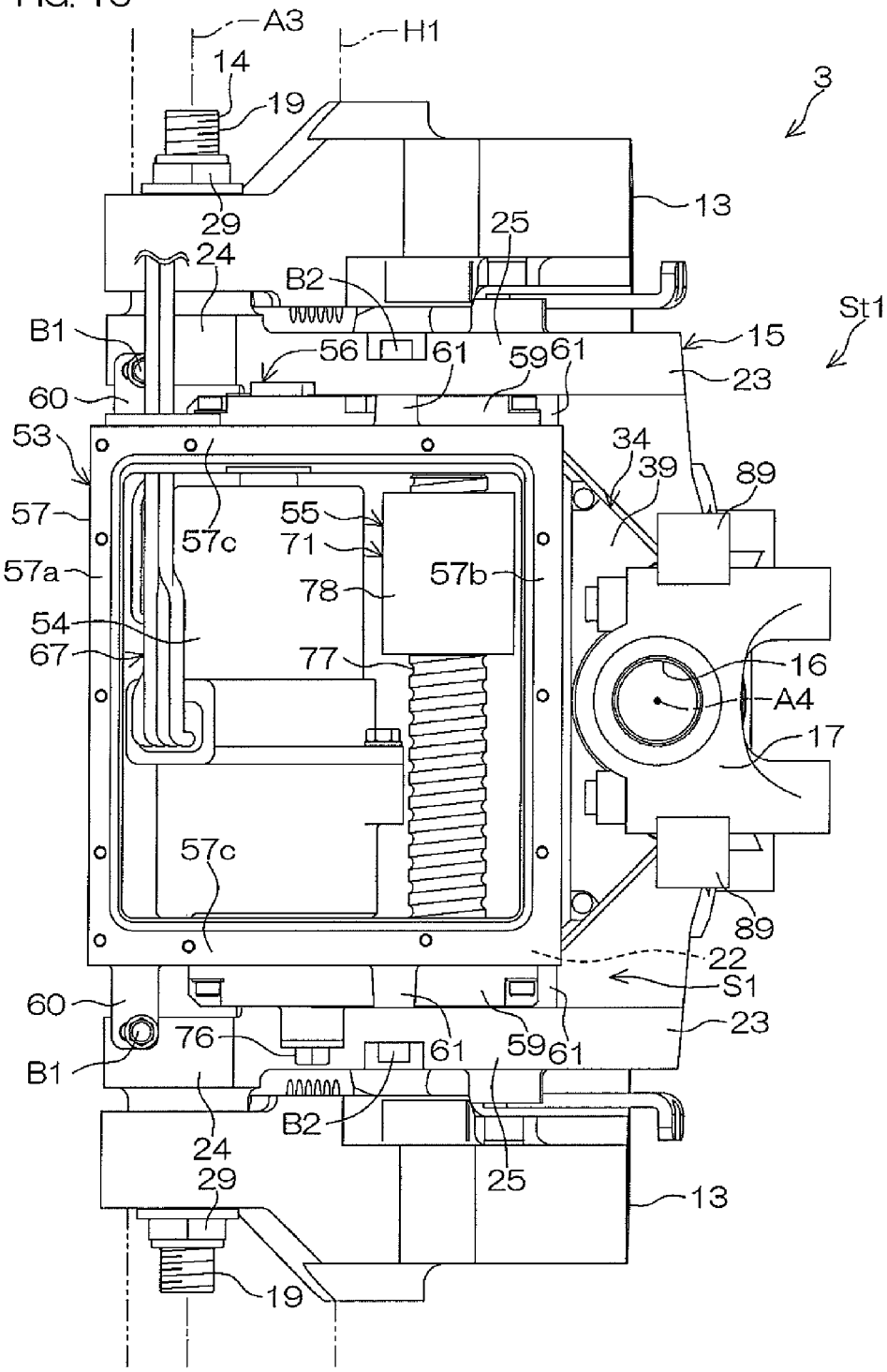
FIG. 16 is a plan view of the suspension device with the electric steering mechanism attached to the swivel bracket.
Figure 17:
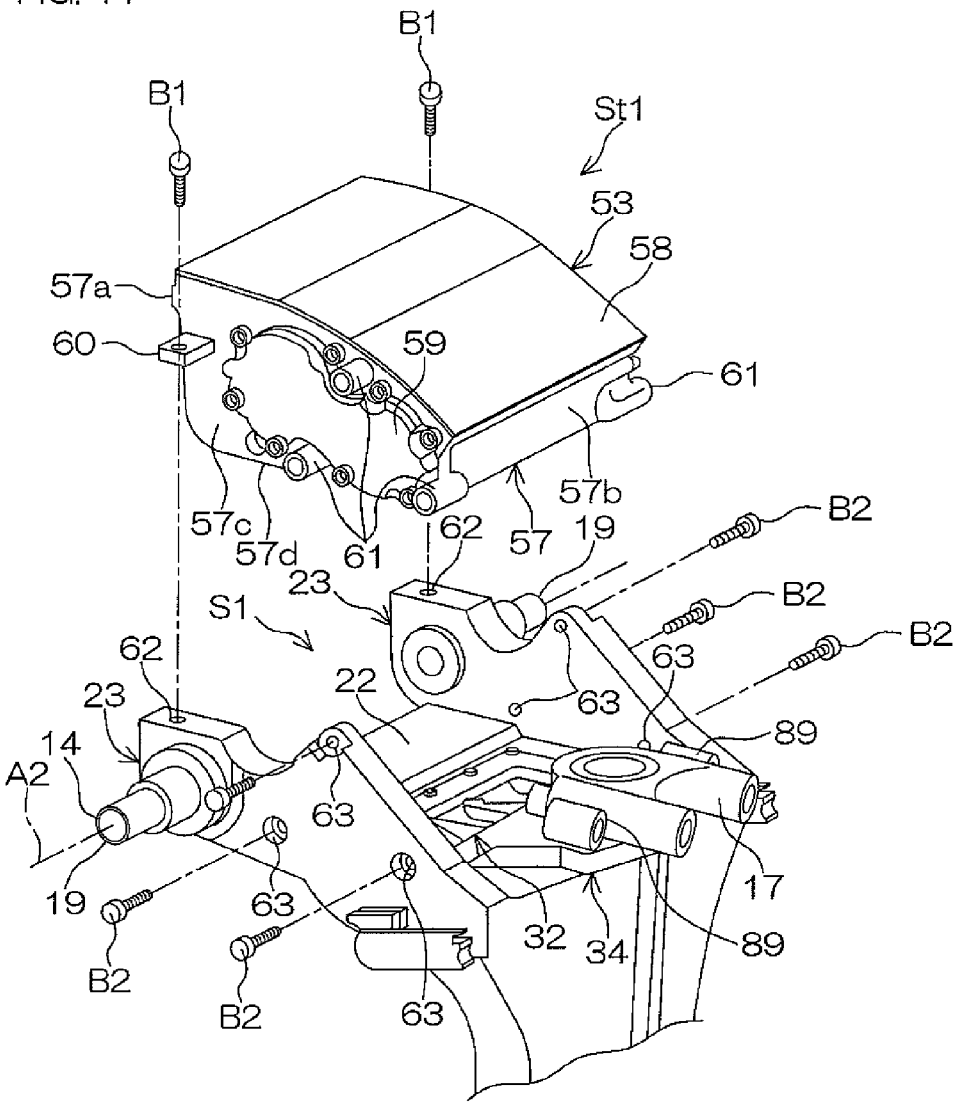
FIG. 17 is a perspective view showing a state before the electric steering mechanism is attached to the swivel bracket.
Figure 18:
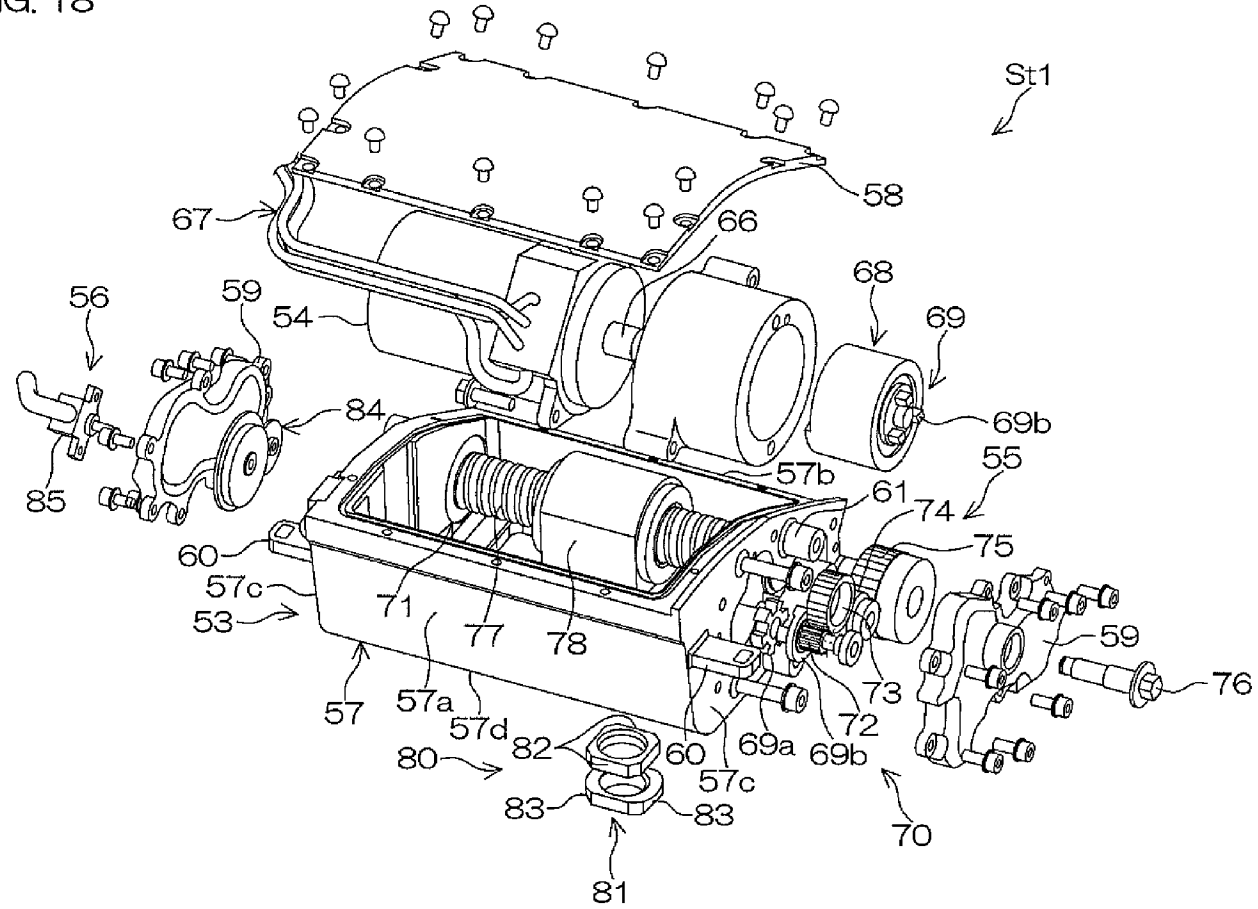
FIG. 18 is an exploded perspective view of the electric steering mechanism viewed from above.
Figure 19:
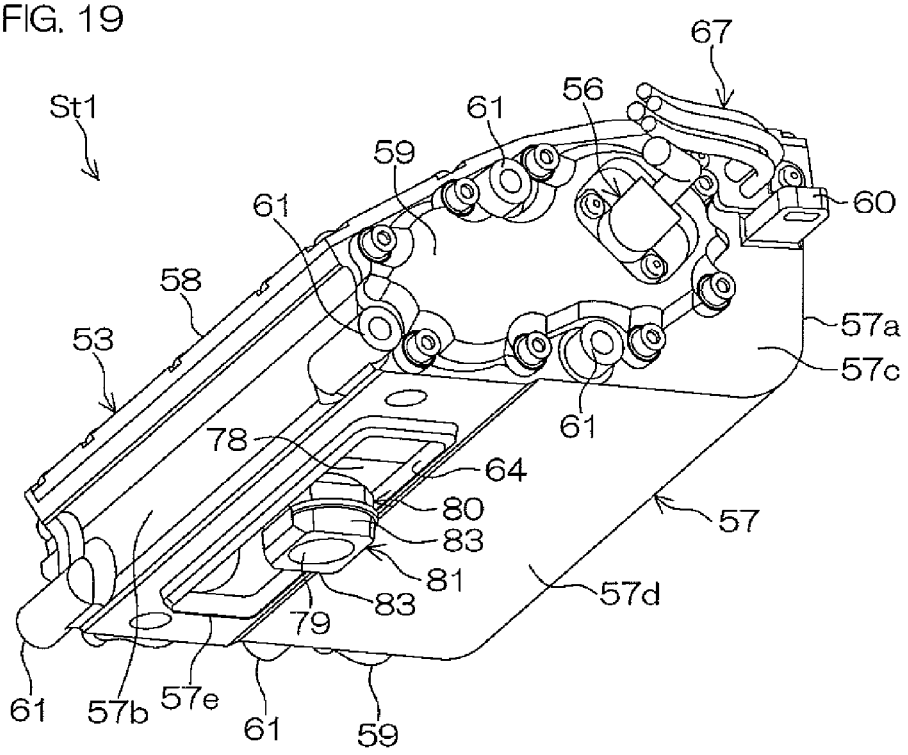
FIG. 19 is a perspective view of the electric steering mechanism viewed from below.
Figure 20:
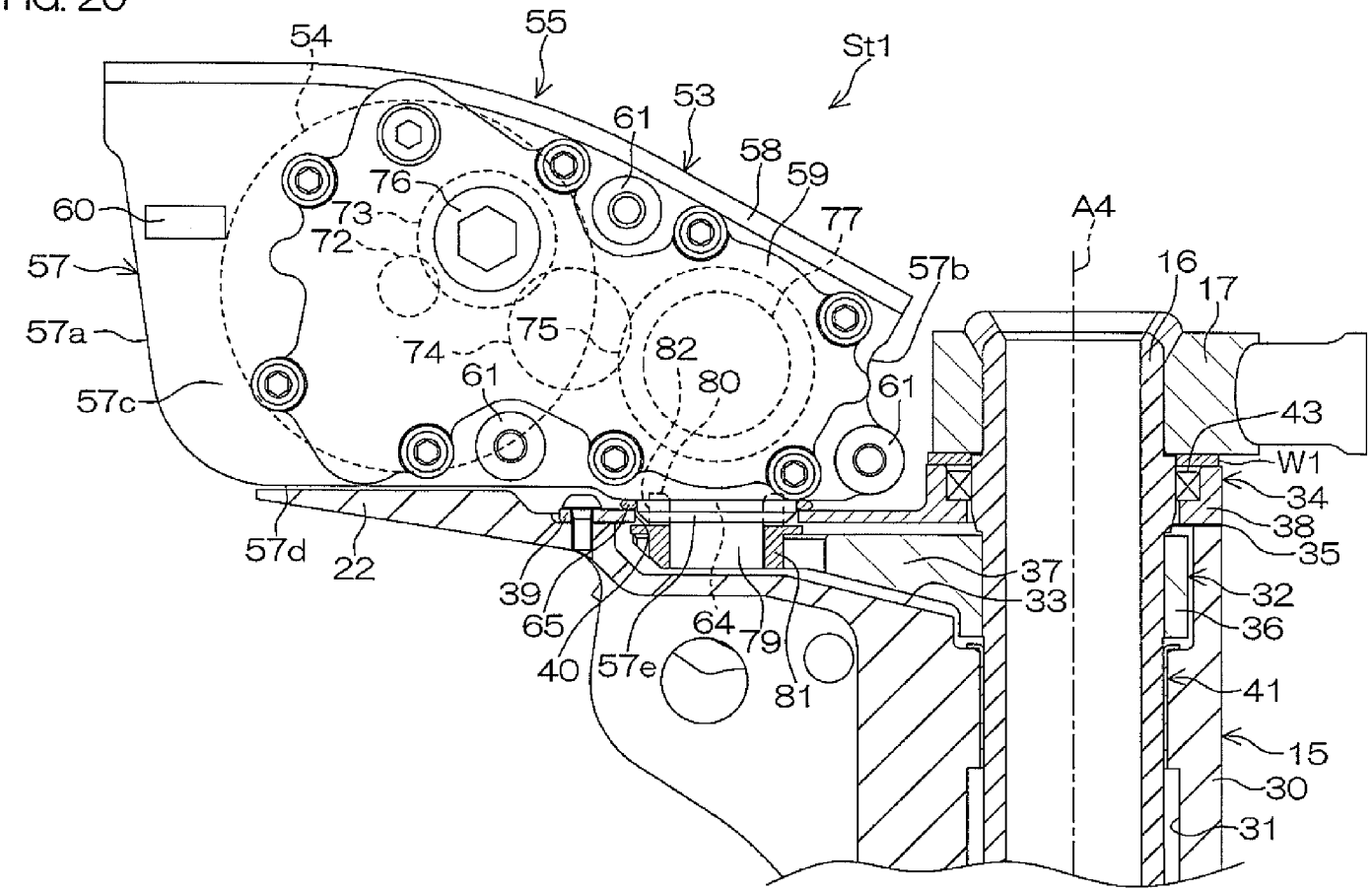
FIG. 20 is a longitudinal sectional view showing an attached state of the electric steering mechanism to the swivel bracket.

FIG. 16 is a plan view of the suspension device 3 with the electric steering mechanism St1 attached. In FIG. 16, illustration of an upper cover 58 is omitted. FIG. 17 is a perspective view showing a state before the electric steering mechanism St1 is attached to the swivel bracket 15. FIG. 18 is an exploded perspective view of the electric steering mechanism St1 viewed from above. FIG. 19 is a perspective view of the electric steering mechanism St1 viewed from below. FIG. 20 is a longitudinal sectional view showing an attached state of the electric steering mechanism St1 to the swivel bracket 15.

As shown in FIG. 16, the electric steering mechanism St1 includes a case 53, an electric motor 54 housed in the case 53, a transmitter 55 that transmits power from the electric motor 54 to the steering shaft 16 side, and a turning angle detector 56 that detects a turning angle of the outboard motor 2. The electric motor 54, the transmitter 55, and the turning angle detector 56 are held by the case 53. The case 53 is removably attached to the swivel bracket 15. Therefore, the electric motor 54, the transmitter 55, and the turning angle detector 56 are removably attached to the swivel bracket 15 via the case 53. When the case 53 is removed from the swivel bracket 15, the electric motor 54, the transmitter 55, and the turning angle detector 56 are also removed from the swivel bracket 15.

As shown in FIG. 16, at least a portion of the case 53 is disposed between the pair of wall portions 23 of the swivel bracket 15. The case 53 is located on the placing portion 22 of the swivel bracket 15. As shown in FIG. 17, the placing portion 22 and the pair of wall portions 23 define a recessed disposition space S1 depressed downward. The disposition space S1 is not only opened upward, but is opened also forward and rearward. As shown in FIG. 16, at least a portion of the case 53 is disposed in the disposition space S1. The upper mount support portion 17 is disposed behind the case 53. The two divided shafts 19 are disposed on both left and right sides of a front end portion of the case 53. Therefore, the tilt axis A3 intersects the case 53. The case 53 is disposed below the engine cover 9 (refer to FIG. 3).

As shown in FIG. 18, the case 53 includes a box-shaped housing 57 with an opening provided in its upper portion, an upper cover 58 that covers the upper portion of the housing 57, and a pair of side covers 59 provided on both left and right sides of the housing 57. The housing 57 includes a front wall 57*a* and a rear wall 57*b* opposed to each other in the front-rear direction, a pair of left and right sidewalls 57*c* (a right sidewall 57*c* and a left sidewall 57*c*) opposed to each other in the left-right direction, and a bottom wall 57*d* that constitutes a bottom portion of the housing 57. The right side cover 59 is attached to the right sidewall 57*c* preferably by a plurality of bolts, and the left side cover 59 is attached to the left sidewall 57*c* preferably by a plurality of bolts, for example. An opening provided in each sidewall 57*c* is covered with the side cover 59. The right sidewall 57*c* of the housing 57 and the right side cover 59 constitute a right side portion of the case 53, and the left sidewall 57*c* of the housing 57 and the left side cover 59 constitute a left side portion of the case 53. As shown in FIG. 16, the right wall portion 23 is opposed to the right side portion of the case 53, and the left wall portion 23 is opposed to the left side portion of the case 53. Each side cover 59 is disposed between the housing 57 and the wall portion 23. Each side cover 59 is opposed to the inner surface of the wall portion 23 at an interval in the left-right direction.

As shown in FIG. 18, the case 53 includes a pair of left and right projections 60 that project laterally from the right side portion and left side portion of the case 53, respectively, and pluralities of first boss portions 61 that project laterally from the right side portion and left side portion of the case 53, respectively. The pair of projections 60 are disposed closer to the front than the pluralities of first boss portions 61. As shown in FIG. 16, the right projection 60 is disposed on the right wall portion 23, and the left projection 60 is disposed on the left wall portion 23. As shown in FIG. 17, each up-down bolt B1 is attached to the wall portion 23 from above via an up-down mounting hole 62 that penetrates through the projection 60 in the up-down direction. Therefore, each projection 60 is removably fixed to the wall portion 23.

As shown in FIG. 16, the plurality of first boss portions 61 are interposed between the side portion of the case 23 and the wall portion 23. Each first boss portion 61 extends in the left-right direction. Each first boss portion 61 includes a flat end surface, and the inner surface of the wall portion 23 opposed to the end surface of the first boss portion 61 is also flat. The end surface of each first boss portion 61 is in surface contact with the inner surface of the wall portion 23. As shown in FIG. 17, each left-right bolt B2 is attached to the first boss portion 61 from the side via a left-right mounting hole 63 that penetrates through the wall portion 23 in the left-right direction. Therefore, the plurality of first boss portions 61 are removably fixed to the wall portion 23 in a state of the end surface of each first boss portion 61 and the inner surface of the wall portion 23 being in surface contact. Thus, each wall portion 23 is supported from the inside by the case 53. Each wall portion 23 is connected to the side portion of the case 53 in a state opposed to the sidewall 57*c* of the housing 57 at an interval in the left-right direction.

As shown in FIG. 19, the case 53 includes an annular opening portion 57*e* provided in the bottom wall 57*d* of the housing 57. The opening portion 57*e* projects downward from a lower surface of the bottom wall 57*d*. The opening portion 57*e* defines a first opening 64 that penetrates the bottom wall 57*d* of the housing 57 in the up-down direction. The first opening 64 preferably is a slit that is elongated in the left-right direction. The first opening 64 causes the interior of the case 53 and the exterior of the case 53 communicate with each other. A portion of the transmitter 55 (a transmission shaft 79 to be described later) projects from the interior of the case 53 to the exterior of the case 53 through the first opening 64. As shown in FIG. 20, the suspension device 3 includes an annular first seal 65 attached to the opening 57*e*. The first seal 65 surrounds the first opening 64. The first opening 64 is opposed to the second opening 40 provided in the arm cover 34. The case 53 is fixed to the swivel bracket 15 in a state of the first opening 64 and the second opening 40 facing each other. The first opening 64 communicates with the arm housing portion 33 via the second opening 40. Therefore, the interior of the case 53 communicates with the arm housing portion 33 via the first opening 64 and the second opening 40.

As shown in FIG. 20, the first seal 65 is disposed between the case 53 and the arm cover 34. The projections 60 and the first boss portions 61 are fixed to the swivel bracket 15 preferably by the up-down bolts B1 and the left-right bolts B2, respectively, at positions where the first seal 65 is sandwiched in the up-down direction between the case 53 and the swivel bracket 15. Therefore, the case 53 is fastened to the swivel bracket 15 in a state of the first seal 65 being sandwiched in the up-down direction between the case 53 and the swivel bracket 15. Accordingly, the case 53 and the arm cover 34 are sealed therebetween.

There is a seal that seals an area between the upper cover 58 and the housing 57 and between the side cover 59 and the housing 57, so that entry of water into the case 53 from a site other than the first opening 64 is prevented. The interior of the case 53 communicates with the arm housing portion 33 via the first opening 64 and the second opening 40. The arm housing portion 33 communicates with the shaft insertion hole 31. As previously described, entry of water into the shaft insertion hole 31 is prevented by the upper seal 43 and the lower seal 44, and entry of water into the arm housing portion 33 from the peripheral edge portion of the arm cover 34 is prevented by the second seal 35. Accordingly, entry of water into the case 53 is prevented. Thus, adhesion of water to the constituents in the case 53 such as the electric motor 54 is prevented.

Figure 21:
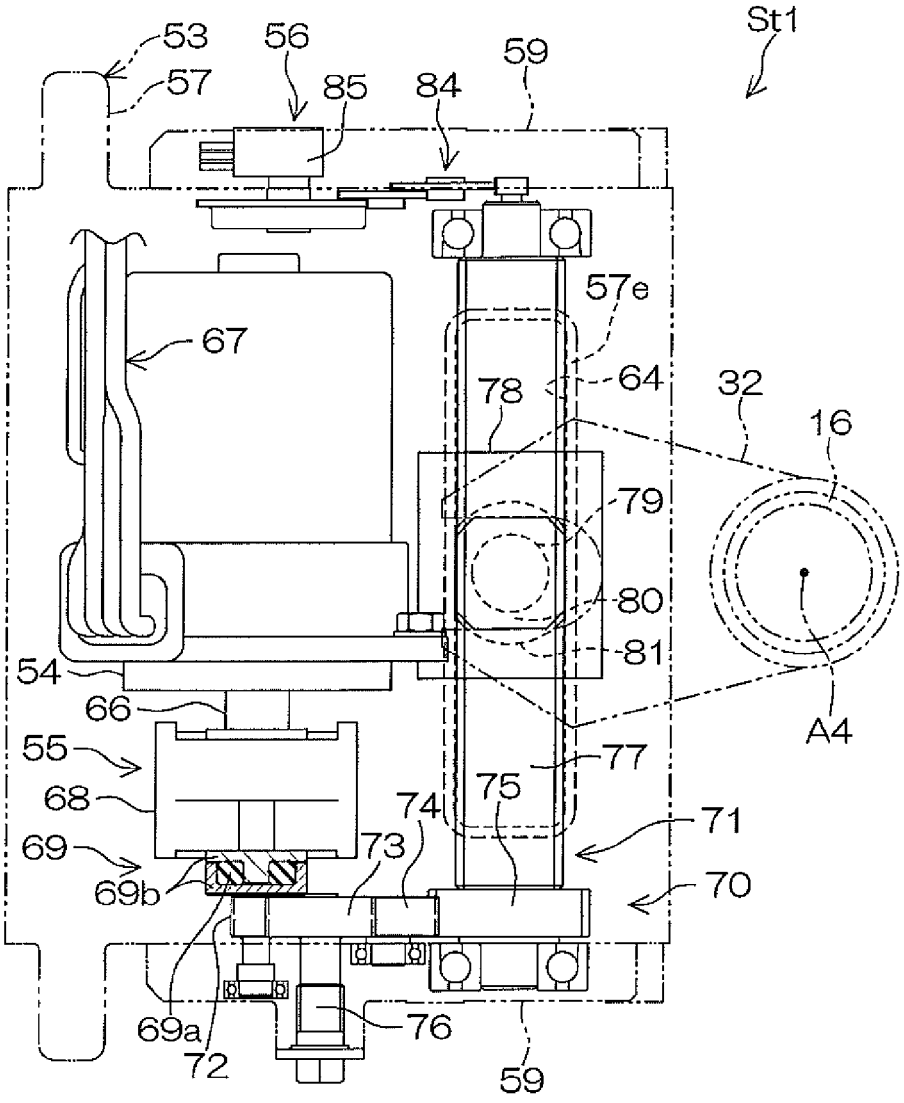
FIG. 21 is schematic view of the interior of the case viewed from above.
Figure 22:
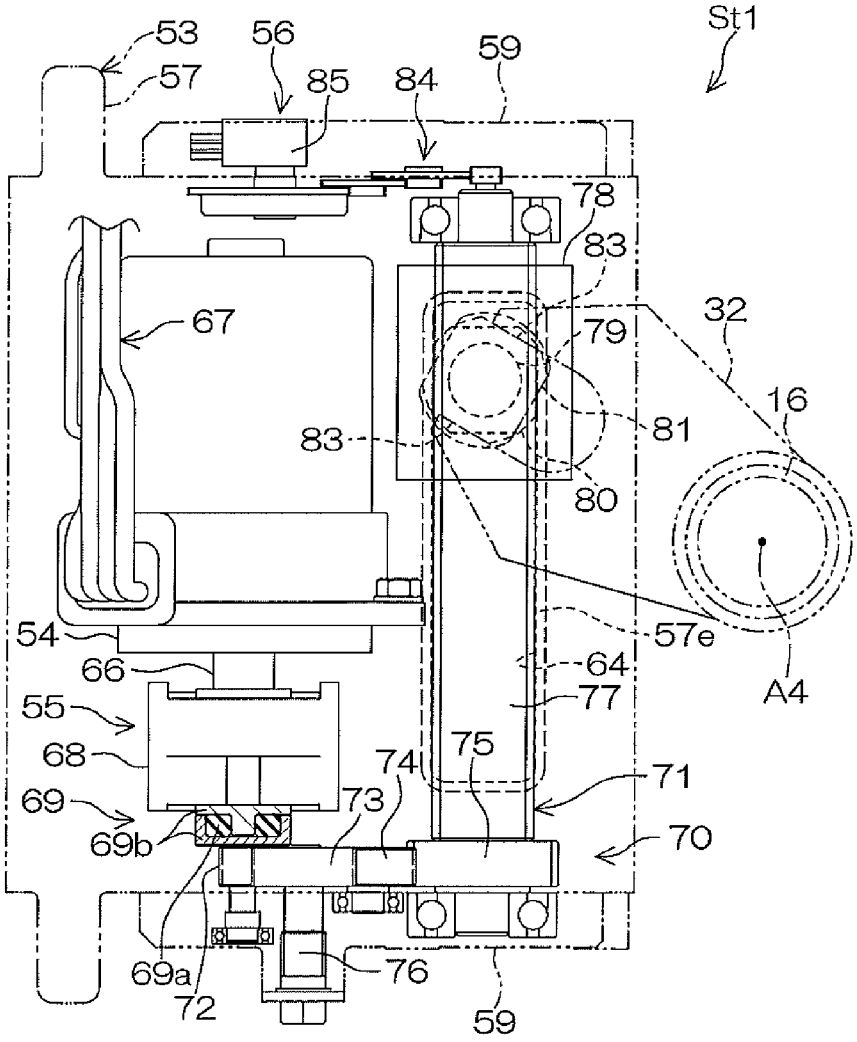
FIG. 22 is schematic view of the interior of the case viewed from above.

FIG. 21 and FIG. 22 are schematic views of the interior of the case 53 viewed from above. FIG. 21 shows a state before the steering shaft 16 and the first steering arm 32 are turned, and FIG. 22 shows a state after the steering shaft 16 and the first steering arm 32 are turned. In the following, the electric steering mechanism St1 will be described with reference to FIG. 18, FIG. 20, FIG. 21, and FIG. 22.

As shown in FIG. 21, the electric motor 54 is disposed inside the case 53 in a posture with a rotation shaft 66 extending in the left-right direction. A plurality of wires 67 including electrical wires extend to the exterior of the case 53 from the electric motor 54 through a wiring hole that penetrates through the case 53. The electric motor 54 produces power (torque) to turn the steering shaft 16 about the steering axis A4. The power of the electric motor 54 is transmitted to the steering shaft 16 through a transmission channel connecting the electric motor 54 and the first steering arm 32. The electric motor 54 is disposed in the interior of the case 53, and the first steering arm 32 is disposed on the exterior of the case 53, so that the transmission channel extends from the interior of the case 53 to the exterior of the case 53 through the first opening 64. The transmitter 55 is disposed on the transmission channel. The transmitter 55 includes a clutch 68, a coupling 69, a decelerator 70, and a motion converter 71 disposed on the transmission channel. The clutch 68, the coupling 69, the decelerator 70, and the motion converter 71 are held by the case 53 in the interior of the house 53.

As shown in FIG. 21, the clutch 68 and the coupling 69 are disposed on a rotation axis of the electric motor 54 (on a central axis of the rotation shaft 66). The clutch 68 is disposed between the electric motor 54 and the coupling 69. The clutch 68 is a reverse input shutoff clutch that transmits torque in a normal rotation direction and a reverse rotation direction from the electric motor 54 side to the steering shaft 16 side, and shuts off torque transmission from the steering shaft 16 side to the electric motor 54 side. The coupling 69 is disposed closer to the steering shaft 16 than the clutch 68 (a downstream side of the transmission channel). As shown in FIG. 18, the coupling 69 is an elastic coupling including a pair of engaging members 69*b* that engage each other via an elastic body 69*a*. Therefore, the coupling 69 functions as a damper that absorbs vibration in a normal rotation direction and a reverse rotation direction. Thus, a reverse input that is input into the coupling 69 from a downstream side of the coupling 69 is transmitted to the clutch 63 while being dampened by the coupling 69. Accordingly, the clutch 68 is prevented from receiving a large reverse input.

As shown in FIG. 21, the decelerator 70 is disposed in the left side portion of the case 53. The decelerator 70 is disposed between the coupling 69 and the motion converter 71 in terms of a power transmission direction. The decelerator 70 decelerates a rotation from the coupling 69, and transmits the decelerated rotation to the motion converter 71 side. The decelerator 70 includes a plurality of reduction gears. In FIG. 21, shown is a case where the decelerator 70 includes four reduction gears (a first reduction gear 72, a second reduction gear 73, a third reduction gear 74, and a fourth reduction gear 75).

As shown in FIG. 21, the four reduction gears are held by the case 53 rotatably about an axis extending in the left-right direction. The first reduction gear 72, the second reduction gear 73, the third reduction gear 74, and the fourth reduction gear 75 are disposed along the transmission channel in this order from the upstream side. The most upstream-side first reduction gear 72 is disposed on the rotation axis of the electric motor 54, and the most downstream-side fourth reduction gear 75 is disposed on a rotation axis of a ball screw 77 to be described later.

As shown in FIG. 21, the first reduction gear 72, the third reduction gear 74, and the fourth reduction gear 75 are supported by the case 53 rotatably via a bearing. The second reduction gear 73 is supported by an unlocking shaft 76 rotatably via a bearing. The unlocking shaft 76 is attached to the side cover 59 from the side. The unlocking shaft 76 extends in the left-right direction. The unlocking shaft 76 is attached to the side cover 59 so as to be axially movable relative to the side cover 59. The second reduction gear 73 moves axially together with the unlocking shaft 76.

The second reduction gear 73 is movable inside the case 53 between an engaging position and a disengaging position. The engaging position is a position where the first reduction gear 72 and the second reduction gear 73 are engaged with each other and the second reduction gear 73 and the third reduction gear 74 are engaged with each other. The disengaging position is a position where the second reduction gear 73 is retracted to the side of the first reduction gear 72 and the third reduction gear 74, and engagement of the first reduction gear 72 and the second reduction gear 73 and engagement of the second reduction gear 73 and the third reduction gear 74 are released. In FIG. 21 and FIG. 22, a state where the second reduction gear 73 is disposed at the engaging position is shown. The second reduction gear 73 is disposed at either one of the engaging position and disengaging position by an operator operating the unlocking shaft 76.

In a state where the second reduction gear 73 is disposed at the engaging position, torque transmitted to the first reduction gear 72 from the coupling 69 is transmitted to the third reduction gear 74 via the second reduction gear 73. Then, the torque transmitted to the third reduction gear 74 is transmitted to the fourth reduction gear 75 from the third reduction gear 74. Moreover, in this state, the clutch 68 arranged to shut off a reverse input is connected to the second reduction gear 73 via the first reduction gear 72 and the coupling 69, so that even when a reverse input (torque) is input to the second reduction gear 73 from the third reduction gear 74, the second reduction gear 73 does not rotate.

On the other hand, in a state where the second reduction gear 73 is disposed at the disengaging position, the first reduction gear 72 is not in engagement with the second reduction gear 73, so that torque transmitted to the first reduction gear 72 from the coupling 69 is not transmitted to the second reduction gear 73, and the first reduction gear 72 runs freely. Similarly, in this state, the third reduction gear 74 is not in engagement with the second reduction gear 73, so that torque transmitted to the third reduction gear 74 from the fourth reduction gear 75 is not transmitted to the second reduction gear 73, and the third reduction gear 74 runs freely. Thus, in this state, rotation is not transmitted to the downstream side from the upstream side of the second reduction gear 73, and rotation is not transmitted to the upstream side from the downstream side of the second reduction gear 73.

The outboard motor 2 is connected to the transmitter 55 via the steering shaft 16 and the first steering arm 32. When an operator pushes the outboard motor 2 left and right, this force (reverse input) is transmitted to the fourth reduction gear 75, and torque is transmitted to the third reduction gear 74 from the fourth reduction gear 75. In the state where the second reduction gear 73 is disposed at the engaging position, a rotation of the second reduction gear 73 is prevented by the clutch 68, so that even when the operator pushes the outboard motor 2 left and right in this state, the outboard motor 2 does not move. On the other hand, in the state where the second reduction gear 73 is disposed at the disengaging position, the second reduction gear 73 is not in engagement with the third reduction gear 74, so that when the operator pushes the outboard motor 2 left and right in this state, the outboard motor 2 turns left and right about the steering axis A4.

As shown in FIG. 21, the motion converter 71 includes a ball screw 77 to be rotationally driven by the electric motor 54 and a ball nut 78 attached to the ball screw 77 via a plurality of balls. The ball screw 77 and the ball nut 78 are disposed closer to the rear than the electric motor 54 in the case 53. The ball screw 77 extends in the left-right direction behind the electric motor 54. Both end portions of the ball screw 77 are supported by the case 53 via bearings. The ball screw 77 is turnable relative to the case 53 about a central axis of the ball screw 77. The rotation axis of the ball screw 77 and the rotation axis of the electric motor 54 are parallel or substantially parallel to each other. The ball screw 77 is connected to the electric motor 54 via the clutch 68, the coupling 69, and the decelerator 70. The ball screw 77 rotates together with the fourth reduction gear 75 of the decelerator 70. When the ball screw 77 rotates about the central axis of the ball screw 77, the ball nut 78 moves in the axial direction of the ball screw 77 along the ball screw 77. Accordingly, a rotation of the ball screw 77 is converted to a linear motion of the ball nut 78.

The transmitter 55 includes a transmission shaft 79 that transmits power from the motion converter 71 side to the first steering arm 32 side. As shown in FIG. 20, the transmission shaft 79 extends downward from the ball nut 78. The transmission shaft 79 projects to the exterior of the case 53 from the interior of the case 53 through the opening portion 57*e* provided in the bottom wall 57*d* of the housing 57. The transmission shaft 79 is disposed on the transmission channel. The transmission shaft 79 moves in the axial direction (left-right direction) of the ball screw 77 together with the ball nut 78. The transmission shaft 79 may be integrated with the ball nut 78, or may be a member different from the ball nut 78 fixed to the ball nut 78.

As shown in FIG. 20, the suspension device 3 includes a tubular first bushing 80 and second bushing 81 in which the transmission shaft 79 is inserted. The first bushing 80 is disposed above the second bushing 81. The first bushing 80 surrounds the transmission shaft 79 in the interior of the case 53. The first bushing 80 is disposed inside the opening 57*e* of the housing 57. On the other hand, the second bushing 81 surrounds the transmission shaft 79 at the exterior of the case 53. The second bushing 81 is disposed inside the arm housing portion 33. The arm portion 37 of the first steering arm 32 is disposed around the second bushing 81. Therefore, the second bushing 81 is disposed between the first steering arm 32 and the transmission shaft 79.

As shown in FIG. 18, the first bushing 80 includes an outer peripheral surface having a polygonal sectional shape and a cylindrical inner peripheral surface. The outer peripheral surface of the first bushing 80 includes two mutually parallel or substantially parallel first flat portions 82. One first flat portion 82 is provided at a front surface of the first bushing 80, and the other first flat portion 82 is provided at a rear surface of the first bushing 80. As shown in FIG. 20, the two first flat portions 82 are opposed in the front-rear direction to an inner surface of the opening portion 57*e* extending in the left-right direction. A rotation of the ball nut 78 about the central axis of the ball screw 77 is restricted by contact between the first flat portion 82 and the opening portion 57*e*. Further, the two first flat portions 82 slide in contact with the inner surface of the opening portion 57*e*, while guiding the ball nut 78 and the transmission shaft 79 in the left-right direction along the opening portion 57*e*. Therefore, the first bushing 80 is preferably made of a material having a lower strength than that of the first steering arm 32 and the transmission shaft 79, such as a resin material.

As shown in FIG. 18, the second bushing 81 includes an outer peripheral surface having a polygonal sectional shape and a cylindrical inner peripheral surface. The outer peripheral surface of the second bushing 81 includes two mutually parallel or substantially parallel second flat portions 83. As shown in FIG. 21, the arm portion 37 of the first steering arm 32 is disposed around the second bushing 81. The second flat portion 83 is opposed to an inner surface of the arm portion 37. A rotation of the first steering arm 32 relative to the second bushing 81 is restricted by contact between the second flat portion 83 and the inner surface of the arm portion 37. The second bushing 81 slides in contact with an outer peripheral surface of the transmission shaft 79, while rotating about a central axis of the transmission shaft 79 relative to the transmission shaft 79 together with the first steering arm 32. Therefore, the second bushing 81 is preferably made of a material having a lower strength than that of the first steering arm 32 and the transmission shaft 79, such as a resin material.

As shown in FIG. 21 and FIG. 22, when the electric motor 54 rotates the rotation shaft 66, a rotation of the electric motor 54 is transmitted to the ball screw 77 via the clutch 68, the coupling 69, and the decelerator 70, and the ball nut 78 and the transmission shaft 79 move in the left-right direction. Accordingly, the first bushing 80 and the second bushing 81 move in the left-right direction, and the first steering arm 32 is pushed in the left-right direction by the second bushing 81. Thus, the first steering arm 32 turns left and right about the steering axis A4, and the second bushing 81 turns about the central axis of the transmission shaft 79 relative to the transmission shaft 79. Accordingly, the outboard motor 2 and the steering shaft 16 turn left and right about the steering axis A4. When the electric motor 54 rotates the rotation shaft 66 in a normal rotation direction, the outboard motor 2 turns right, and when the electric motor 54 rotates the rotation shaft 66 in a reverse rotation direction (a direction opposite to the normal rotation direction), the outboard motor 2 turns left. Consequently, the outboard motor 2 is disposed at any position from the maximum right turning position to the maximum left turning position.

The turning angle of the outboard motor 2 is detected by the turning angle detector 56. As shown in FIG. 21, the turning angle detector 56 is disposed in the right side portion of the case 53. The turning angle detector 56 is a rotation angle detector that detects a rotation angle (rotational position) of the steering shaft 16 by detecting a rotation angle (rotational position) of the ball screw 77. The turning angle detector 56 preferably is a linear sensor that detects a rotation angle of the steering shaft 16 by detecting an amount of movement of the ball nut 78 in the axial direction. The turning angle detector 56 preferably includes a plurality of gears 84 and a sensor 85. The plurality of gears 84 are disposed between the right side cover 59 and the right side wall 57*c* of the housing 57. The plurality of gears 84 rotate in accordance with a rotation of the ball screw 77. The rotation of the ball screw 77 is decelerated by the plurality of gears 84 in sequence. The sensor 85 detects a rotation angle of the ball screw 77 based on a rotation angle of the most downstream-side gear 84. Accordingly, the turning angle of the outboard motor 2 is detected.

Next, description will be given of the case where the suspension device 3 includes the hydraulic steering mechanism St2.

Figure 23:
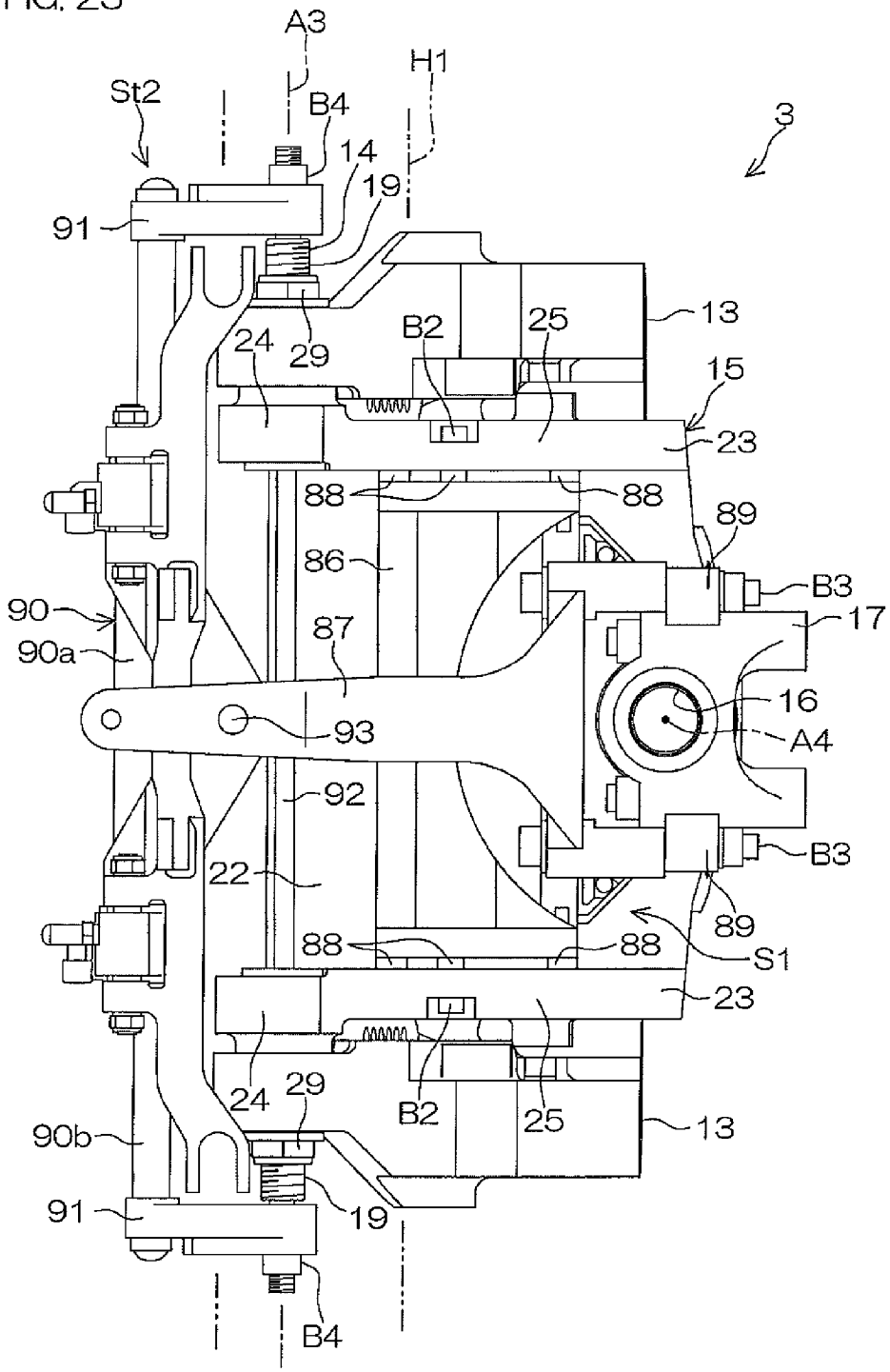
FIG. 23 is a plan view of the suspension device with the hydraulic steering mechanism attached to the swivel bracket.
Figure 24:
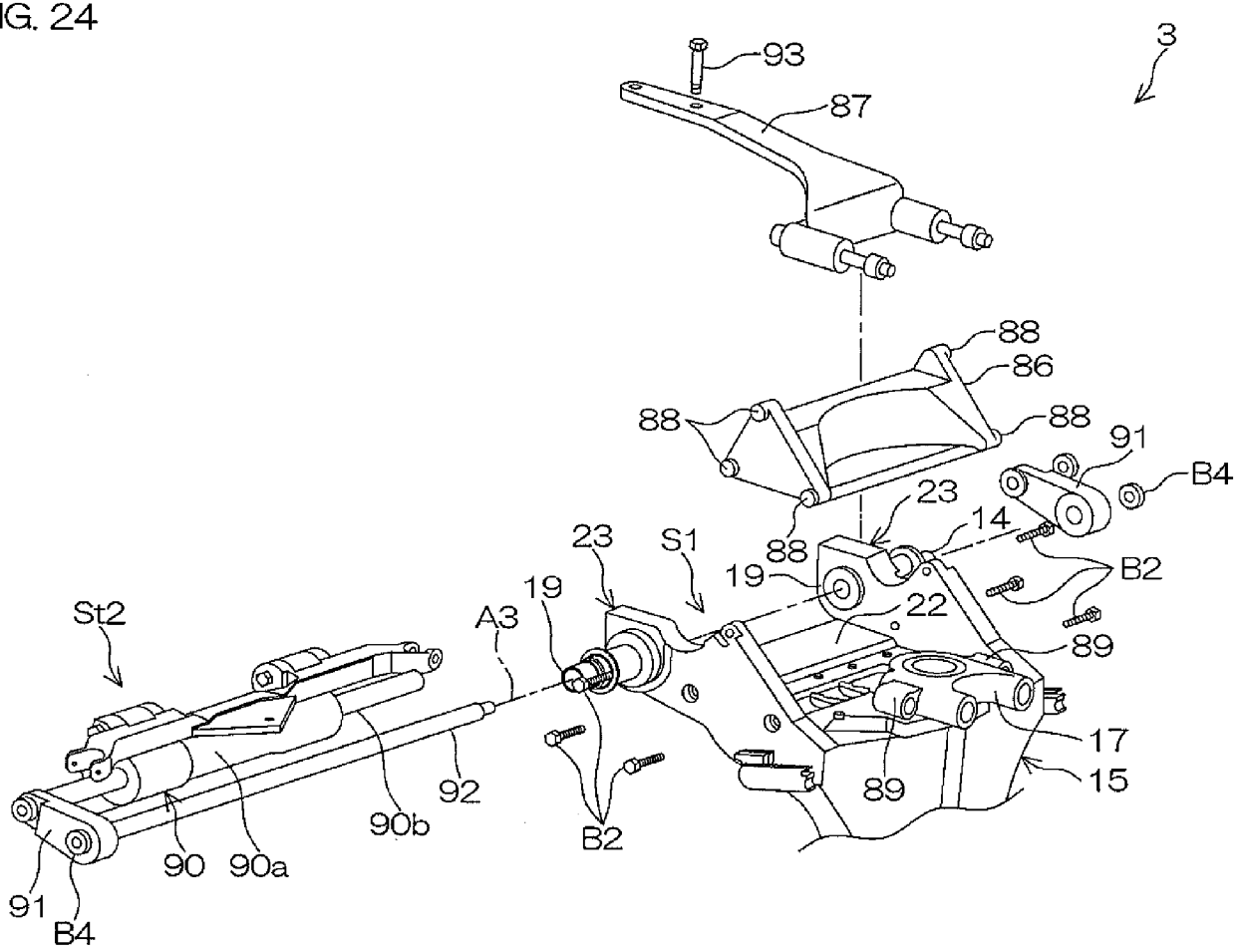
FIG. 24 is a perspective view showing a state before the hydraulic steering mechanism is attached to the swivel bracket.

FIG. 23 is a plan view of the suspension device 3 with the hydraulic steering mechanism St2 attached. FIG. 24 is a perspective view showing a state before the hydraulic steering mechanism St2 is attached to the swivel bracket 15.

As shown in FIG. 23 and FIG. 24, when the suspension device 3 includes the hydraulic steering mechanism St2, a spacer 86 and a second steering arm 87 are provided in the suspension device 3.

As shown in FIG. 24, the spacer 86 is a block extending in the left-right direction preferably having a triangular or substantially triangular shape in a side view, for example. As shown in FIG. 23, the spacer 86 is disposed between the pair of wall portions 23. The spacer 86 is located on the placing portion 22. The spacer 86 is disposed in the disposition space S1. The spacer 86 is disposed above the second opening 40 provided in the arm cover 34. The second opening 40 is blocked by the spacer 86. The spacer 86 and the arm cover 34 are sealed therebetween. Accordingly, entry of water into the arm housing portion 33 is prevented.

As shown in FIG. 23, the spacer 86 includes pluralities of second boss portions 88 that project laterally from a right side portion and left side portion of the spacer 86, respectively. Each second boss portion 88 extends in the left-right direction. Each second boss portion 88 includes a flat end surface, and the end surface of each second boss portion 88 is in surface contact with the inner surface of the wall portion 23. The positional relationship of the pluralities of second boss portions 88 preferably is the same as the positional relationship of the pluralities of first boss portions 61 provided in the case 53 of the electric steering mechanism St1. Therefore, each second boss portion 88 is opposed to the left-right mounting hole 63 (refer to FIG. 17) that penetrates through the wall portion 23 in the left-right direction. The spacer 86 is fixed to the pair of wall portions 23 by the pluralities of left-right bolts B2. Therefore, the plurality of second boss portions 88 are removably fixed to the wall portion 23 in a state of the end surface of each second boss portion 88 and the inner surface of the wall portion 23 being in surface contact. Thus, each wall portion 23 is supported from the inside by the spacer 86.

As shown in FIG. 23, the second steering arm 87 passes over the spacer 86 and extends to the hydraulic steering mechanism St2 from the upper mount support portion 17. The upper mount support portion 17 includes an arm attaching portion 89 to which one end portion of the second steering arm 87 is removably attached. The second steering arm 87 is removably attached to the arm attaching portion 89 preferably by an arm bolt B3, for example. The second steering arm 87 is supported by the arm attaching portion 89 above the swivel bracket 15. The first steering arm 32 to be connected to the electric steering mechanism St1 is disposed in the interior of the swivel bracket 15. Therefore, the second steering arm 87 is supported by the arm attaching portion 89 at a position higher than that of the first steering arm 32. The second steering arm 87 rotates about the steering axis A4 together with the steering shaft 16. The other end portion of the second steering arm 87 is connected to the hydraulic steering mechanism St2.

As shown in FIG. 23, the hydraulic steering mechanism St2 includes a hydraulic cylinder 90 that produces power, a pair of attaching arms 91 attached to the hydraulic cylinder 90, and an attaching shaft 92 attached to the pair of attaching arms 91. The hydraulic cylinder 90 is a double rod double acting cylinder. The hydraulic cylinder 90 includes a cylinder tube 90*a* to which a hydraulic oil is supplied and a piston rod 90*b* that penetrates through the cylinder tube 90*a* in the left-right direction. The attaching shaft 92 extends in the left-right direction behind the hydraulic cylinder 90. The right attaching arm 91 connects a right end portion of the piston rod 90*b* and a right end portion of the attaching shaft 92, and the left attaching arm 91 connects a left end portion of the piston rod 90*b* and a left end portion of the attaching shaft 92. The pair of attaching arms 91 are disposed in parallel or substantially parallel to each other.

As shown in FIG. 24, the attaching shaft 92 extends in the left-right direction along the tilt axis A3. As shown in FIG. 23, the attaching shaft 92 penetrates through the two divided shafts 19 in the left-right direction. A right end portion of the attaching shaft 92 is disposed on the side further than the right clamp bracket 13 and a left end portion of the attaching shaft 92 is disposed on the side further than the left clamp bracket 13. The attaching shaft 92 is removably attached to the tilting shaft 14 preferably by two bolts B4, for example. The attaching shaft 92 is supported by the tilting shaft 14. Therefore, the hydraulic steering mechanism St2 is supported by the pair of wall portions 23 via the tilting shaft 14. The hydraulic steering mechanism St2 is supported by the swivel bracket 15 closer to the front than the disposition space S1 in which the electric steering mechanism St1 is disposed.

As shown in FIG. 23, the other end portion of the second steering arm 87 is connected to the cylinder tube 90*a* via a turning shaft 93. The other end portion of the second steering arm 87 is turnable relative to the cylinder tube 90*a* about a central axis of the turning shaft 93. When a hydraulic oil is supplied to the inside of the cylinder tube 90*a*, the cylinder tube 90*a* moves in the left-right direction relative to the piston rod 90*b*. The piston rod 90*b* is prevented from moving in the left-right direction by the attaching arm 91 and the attaching shaft 92. Therefore, when a hydraulic oil is supplied to the inside of the cylinder tube 90*a*, the cylinder tube 90*a* moves in the left-right direction relative to the clamp bracket 13 and the swivel bracket 15.

When the cylinder tube 90*a* moves in the left-right direction, the other end portion of the second steering arm 87 turns relative to the cylinder tube 90*a* about the central axis of the turning shaft 93 while moving in the left-right direction. Accordingly, the second steering arm 87 turns left and right about the steering shaft A4. Thus, the outboard motor 2 and the steering shaft 16 turn left and right about the steering axis A4. The outboard motor 2 is disposed at any position from the maximum right turning position to the maximum left turning position by the hydraulic steering mechanism St2.

As above, in the present preferred embodiment, the swivel bracket 15 includes the placing portion 22 serving as a first support portion capable of supporting the electric steering mechanism St1 and the pair of wall portions 23 serving as a second support portion capable of supporting the hydraulic steering mechanism St2 at a position different from that of the electric steering mechanism St1. The swivel bracket 15 is capable of supporting either one of the electric steering mechanism St1 and the hydraulic steering mechanism St2. Therefore, in either case of using the electric steering mechanism St1 or the hydraulic steering mechanism St2, the common swivel bracket 15 can be used. Thus, it is not necessary to prepare a plurality of different specifications of swivel brackets 15. Accordingly, common use of components can be realized.

Moreover, the electric steering mechanism St1 includes the case 53 serving as a holding member to be located on the placing member 22, the electric motor 54 that produces power, and the transmitter 55 that transmits power from the electric motor 54 to the steering shaft 16 side. The case 53 is removably attached to the swivel bracket 15. The electric motor 54 and the transmitter 55 are held by the case 53. Therefore, by removing the case 53 from the swivel bracket 15, the case 53, the electric motor 54, and the transmitter 55 can be removed all at once from the swivel bracket 15. Thus, the electric steering mechanism St1 can be maintained in a state removed from the swivel bracket 15. Consequently, maintenance can be performed more efficiently than when the electric steering mechanism St1 is integrated with the swivel bracket 15. Further, the weight of the suspension device 3 can be greatly reduced when the electric steering mechanism St1 is unnecessary. Furthermore, it is not necessary to replace the swivel bracket 15 when the electric steering mechanism St1 is damaged.

Moreover, each of the upper bearing 41 and the lower bearing 42 that rotatably support the steering shaft 16 includes a tubular metal portion M1 held by the swivel bracket 15 and a resin layer R1 coupled with the inner periphery of the metal portion M1. The resin layer R1 includes a sliding surface that slides in contact with the outer peripheral surface of the steering shaft 16. The metal portion M1 is made of a metal material having a higher strength than that of the resin material. Therefore, the amount of elastic deformation of the upper bearing 41 and the lower bearing 42 is kept small, and rattling of the steering shaft 16 relative to the swivel bracket 15 is significantly reduced. Further, because the metal material has a higher dimensional accuracy than that of resin, a clearance between the outer peripheral surface of the steering shaft 16 and the sliding surface can be precisely controlled. Accordingly, not only can manufacturing variations of the steering shaft 16 be further reduced, but wear of the upper bearing 41 and the lower bearing 42 can also be significantly reduced. Moreover, because the resin layer R1 is layered and thinner than the metal portion M1, variation associated with elastic deformation of the resin layer R1 of the steering shaft 16 is small. Therefore, rattling of the steering shaft 16 can be significantly reduced. Thus, a steering operation of the outboard motor 2 can be controlled with high accuracy.

Other Preferred Embodiments

Although various preferred embodiment of the present invention have been described above, the present invention is not limited to the content of the above-described preferred embodiments, and can be variously modified within the scope of the appended claims.

For example, in the above-described preferred embodiments, the electric motor of the electric steering mechanism is preferably disposed in the interior of the case. However, when a motor including a waterproof structure where entry of water into the interior of the motor is prevented is used as the electric motor, the electric motor may be disposed on the exterior of the case.

Also, in the above-described preferred embodiments, the first boss portions preferably extend from the case to the wall portion side. However, the first boss portions may be provided only at the wall portion, and extend from the inner surface of the wall portion to the case side. Further, the first boss portions may be provided at both of the case and the wall portion. Moreover, the side surface of the case and the inner surface of the wall portion may be in surface contact without the first boss portions being provided at the case or wall portion.

Also, in the above-described preferred embodiments, the hydraulic steering mechanism preferably is connected to the wall portions of the swivel bracket via the tilting shaft. However, the hydraulic steering mechanism may be directly connected to the wall portions. Moreover, the steering mechanism to be connected to the wall portions is not limited to a hydraulic steering mechanism, and may be an electric steering mechanism, for example.

Also, in the above-described preferred embodiments, the tilting shaft preferably is divided into two. However, the tilting shaft may be divided into three or more, and may be an integrated member that penetrates through a pair of clamp brackets in the left-right direction.

Also, in the above-described preferred embodiments, the steering shaft preferably is held by the swivel bracket via the two bearings (upper bearing and lower bearing). However, the number of bearings that support the steering shaft may be one, and may be three or more.

Also, in the above-described preferred embodiments, the steering shaft preferably is held by the swivel bracket and turns up and down with a turn of the outboard motor about the tilt axis. However, the steering shaft may be held by a transom bracket that is attachable to a transom, and arranged not to turn even when the outboard motor turns up and down about the tilt axis.

Also, in the above-described preferred embodiments, the decelerator 70 preferably is disposed in the left side portion of the case 53, and the turning angle detector 56 preferably is disposed in the right side portion of the case 53. However, the decelerator 70 may be disposed in the right side portion of the case 53, and the turning angle detector 56 may be disposed in the left side portion of the case 53.

The structure of the transmitter of the electric steering mechanism is not limited to the structure of the above-described preferred embodiments, and may be the structure disclosed in Japanese Patent Application No. 2010-230851 and U.S. patent application Ser. No. 13/212,247. The entire disclosures of Japanese Patent Application No. 2010-230851 and U.S. patent application Ser. No. 13/212,247 are incorporated herein by reference.

Various other design modifications can be made within the scope of the matters described in the scope of claims.

The present application corresponds to Japanese Patent Application Nos. 2012-065801, 2012-065802, and 2012-065803 filed on Mar. 22, 2012 in the Japan Patent Office, and the entire disclosures of these applications are incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A suspension device for an outboard motor, the suspension device comprising:

a clamp bracket to be attached to a hull;

a tilting shaft connected to the clamp bracket;

a swivel bracket including a first support portion arranged to support a first steering mechanism and a second support portion arranged to support a second steering mechanism at a position different from that of the first steering mechanism, connected to the tilting shaft, rotatable about a central axis of the tilting shaft relative to the clamp bracket, and supporting one of the first steering mechanism and the second steering mechanism;

a steering shaft held by the swivel bracket rotatably about a central axis of the steering shaft so as to be driven about the central axis of the steering shaft by one of the first steering mechanism and the second steering mechanism, the steering shaft arranged to be connected to the outboard motor, the first steering mechanism including a first steering device that produces power to drive the steering shaft, the second steering mechanism including a second steering device that produces power to drive the steering shaft, and the first steering device is different from the second steering device; wherein the first steering mechanism includes a first steering arm connected to the steering shaft and arranged to rotate about the central axis of the steering shaft together with the steering shaft;

the second steering mechanism includes an arm attaching portion connected to the steering shaft arranged to rotate about the central axis of the steering shaft together with the steering shaft; and the arm attaching portion is located at a height higher than that of the first steering arm.

2. The suspension device for an outboard motor according to claim 1, wherein the swivel bracket includes a placing portion defining the first support portion on which the first steering mechanism is located and a pair of wall portions defining the second support portion disposed on both left and right sides of the placing portion, and the placing portion and the pair of wall portions define a recessed disposition space that is open forward and upward and in which the first steering mechanism is disposed.

3. The suspension device for an outboard motor according to claim 2, wherein the tilting shaft includes at least two divided shafts disposed on a same axis.

4. The suspension device for an outboard motor according to claim 3, wherein the at least two divided shafts include shaft portions inserted in insertion holes provided in the pair of wall portions and flange portions disposed between the pair of wall portions and having an outer diameter larger than a diameter of the insertion holes.

5. The suspension device for an outboard motor according to claim 1, wherein the swivel bracket further includes a recessed arm housing portion in which the first steering arm is housed.

6. The suspension device for an outboard motor according to claim 5, further comprising an arm cover attached to the swivel bracket, and covering the arm housing portion.

7. The suspension device for an outboard motor according to claim 6, further comprising a seal disposed between the arm cover and the swivel bracket.

8. The suspension device for an outboard motor according to claim 1, further comprising:

an electric steering mechanism defining the first steering device, supported by the first support portion, and arranged to cause the steering shaft to rotate about the central axis of the steering shaft; wherein the first steering arm includes a first end portion connected to the steering shaft and a second end portion connected to the first steering mechanism.

9. The suspension device for an outboard motor according to claim 8, wherein the first end portion of the first steering arm is fixed to the steering shaft by at least one of press fitting, bolting, and welding.

10. The suspension device for an outboard motor according to claim 1, further comprising:

the second steering mechanism supported by the second support portion and arranged to cause the steering shaft to rotate about the central axis of the steering shaft; and a steering arm including a first end portion connected to the arm attaching portion and a second end portion connected to the second steering mechanism, and arranged to rotate about the central axis of the steering shaft together with the steering shaft.

11. The suspension device for an outboard motor according to claim 10, wherein the tilting shaft is supported by the second support portion; and the second steering mechanism is supported by the second support portion via the tilting shaft.

12. The suspension device for an outboard motor according to claim 10, wherein the first end portion of the steering arm is removably attached to the arm attaching portion by a bolt.

13. The suspension device for an outboard motor according to claim 10, wherein the second steering device is a hydraulic steering mechanism.

14. A vessel propulsion apparatus comprising:

the suspension device according to claim 1; and an outboard motor connected to the steering shaft.

15. A suspension device for an outboard motor, the suspension device comprising:

a clamp bracket to be attached to a hull;

a tilting shaft connected to the clamp bracket;

a swivel bracket connected to the tilting shaft, and rotatable about a central axis of the tilting shaft relative to the clamp bracket; and a steering shaft held by the swivel bracket rotatably about a central axis of the steering shaft, including a first connecting portion connectable to a first steering mechanism and a second connecting portion connectable to a second steering mechanism at a position different from that of the first steering mechanism, to be driven about the central axis of the steering shaft by one of the first steering mechanism connected to the first connecting portion and the second steering mechanism connected to the second connecting portion, and arranged to be connected to the outboard motor; wherein the first steering mechanism includes a first steering device that produces power to drive the steering shaft, the second steering mechanism includes a second steering device that produces power to drive the steering shaft, and the first steering device is different from the second steering device; and the second connecting portion is located at a height higher than that of the first connecting portion.

16. The suspension device for an outboard motor according to claim 15, wherein the first steering device is an electric steering mechanism, and the first connecting portion is a first steering arm connected to the steering shaft, and arranged to rotate about the central axis of the steering shaft together with the steering shaft.

17. The suspension device for an outboard motor according to claim 15, wherein the second steering device is a hydraulic steering mechanism, the second connecting portion is connectable to the second steering mechanism via a steering arm including a first end portion to be connected to the second connecting portion and a second end portion to be connected to the hydraulic steering mechanism, and the steering arm is arranged to rotate about the central axis of the steering shaft together with the steering shaft.

18. A vessel prolusion apparatus comprising:

the suspension device according to claim 15; and an outboard motor connected to the steering shaft.

* * * * *